US011930974B2

(12) United States Patent
Bloemendaal et al.

(10) Patent No.: US 11,930,974 B2
(45) Date of Patent: Mar. 19, 2024

(54) HANDHELD EXTRACTION CLEANER

(71) Applicant: BISSELL Inc., Grand Rapids, MI (US)

(72) Inventors: Colin J. Bloemendaal, Grand Rapids, MI (US); Kin-leung Tam, Kowloon (HK); Wei-min Yi, Shenzhen (CN)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/872,633

(22) Filed: Jul. 25, 2022

(65) Prior Publication Data

US 2022/0354331 A1 Nov. 10, 2022

Related U.S. Application Data

(63) Continuation of application No. 16/851,910, filed on Apr. 17, 2020, now Pat. No. 11,432,696, which is a continuation of application No. 15/800,187, filed on Nov. 1, 2017, now Pat. No. 10,624,515.

(60) Provisional application No. 62/415,634, filed on Nov. 1, 2016.

(51) Int. Cl.

| | |
|---|---|
| ***A47L 11/30*** | (2006.01) |
| ***A47L 1/05*** | (2006.01) |
| ***A47L 9/00*** | (2006.01) |
| ***A47L 11/40*** | (2006.01) |

(52) U.S. Cl.

CPC ..... *A47L 11/30* (2013.01); *A47L 1/05* (2013.01); *A47L 9/0081* (2013.01); *A47L 11/4005* (2013.01); *A47L 11/4016* (2013.01); *A47L 11/4044* (2013.01); *A47L 11/4075* (2013.01); *A47L 11/4083* (2013.01); *A47L 11/4088* (2013.01)

(58) Field of Classification Search

CPC ..... A47L 11/30; A47L 1/05; A47L 11/4005; A47L 11/4016; A47L 11/4044; A47L 11/4075; A47L 11/4083; A47L 11/4088; A47L 1/08; A47L 11/34; A47L 11/40; A47L 9/0081

See application file for complete search history.

(56) References Cited

U.S. PATENT DOCUMENTS

| | | | | |
|---|---|---|---|---|
| 4,776,058 | A | 10/1988 | Millman | |
| 4,788,738 | A | 12/1988 | Perry | |
| 5,367,740 | A | 11/1994 | McCray | |
| 5,507,068 | A | 4/1996 | Brokaw | |
| 5,599,401 | A | 2/1997 | Brosky et al. | |
| 5,799,362 | A | 9/1998 | Huffman | |
| 5,867,864 | A | 2/1999 | Gerber | |
| 6,125,498 | A * | 10/2000 | Roberts | A47L 9/0027 15/352 |

(Continued)

FOREIGN PATENT DOCUMENTS

| | | |
|---|---|---|
| EP | 0847721 B1 | 3/2003 |
| GB | 2331919 A | 9/1999 |

(Continued)

*Primary Examiner* — David Redding
(74) *Attorney, Agent, or Firm* — Quinn IP Law

(57) ABSTRACT

A handheld extraction cleaner includes a unitary body provided with a carry handle, and further provided with a supply tank, a recovery tank, and a suction source, all of which are carried on the unitary body. The various components of the extraction cleaner can be arranged for a balanced weight in hand. The supply tank can be integrated with a fluid distributor in a removable, modular unit.

19 Claims, 18 Drawing Sheets

(56) References Cited

U.S. PATENT DOCUMENTS

| | | | | |
|---|---|---|---|---|
| 6,189,178 | B1 | 2/2001 | Roberts | |
| 6,347,428 | B1 | 2/2002 | Shimko | |
| 6,550,098 | B2 | 4/2003 | Reed, Jr. | |
| 6,658,693 | B1 | 12/2003 | Reed, Jr. | |
| 6,968,593 | B1 | 11/2005 | Hoang | |
| 7,073,226 | B1 | 7/2006 | Lenkiewicz et al. | |
| 7,225,503 | B1 | 6/2007 | Krebs | |
| 9,474,424 | B2 | 10/2016 | Moyher, Jr et al. | |
| 10,624,515 | B2 | 4/2020 | Bloemendaal et al. | |
| 2002/0073504 | A1 | 6/2002 | Hall et al. | |
| 2008/0235898 | A1* | 10/2008 | Haan | A47L 11/40 15/413 |
| 2015/0174620 | A1 | 6/2015 | Liang | |
| 2016/0128528 | A1 | 5/2016 | Sandra | |
| 2018/0110388 | A1 | 4/2018 | Xia et al. | |
| 2018/0116476 | A1 | 5/2018 | Bloemendaal et al. | |

FOREIGN PATENT DOCUMENTS

| | | | |
|---|---|---|---|
| WO | 2009086892 | A1 | 7/2009 |
| WO | 2015007327 | A1 | 1/2015 |
| WO | 2016029967 | A1 | 3/2016 |
| WO | 2017092832 | A1 | 6/2017 |
| WO | 2017108089 | A1 | 6/2017 |
| WO | 2019053000 | A1 | 3/2019 |

* cited by examiner

HANDHELD EXTRACTION CLEANER

CROSS-REFERENCE TO RELATED APPLICATION(S)

This application is a continuation of U.S. patent application Ser. No. 16/851,910 filed Apr. 17, 2020, now allowed, which claims the benefit of U.S. patent application Ser. No. 15/800,187 filed Nov. 1, 2017, now allowed, which claims the benefit of U.S. Provisional Patent Application No. 62/415,634, filed Nov. 1, 2016, all of which are incorporated herein by reference in their entirety.

BACKGROUND

Extraction cleaners can be embodied as upright units or portable, hand-carriable units. Handheld extraction cleaners can include a cleaning solution supply tank and a recovery tank. These extraction cleaners typically have a vacuum motor that powers an impeller to create low pressure on one side of the impeller and higher pressure on the other side thereof. The recovery tank is typically positioned between the low pressure side of the impeller and a fluid collection nozzle to remove fluid from a surface and deposit it in the recovery tank. It is also known to provide a separate cleaning fluid pump for directing cleaning fluid from the supply tank to the surface.

BRIEF DESCRIPTION

Disclosed herein is a handheld extraction cleaner. The handheld extraction cleaner may include a unitary body with a working air path through the body having a dirty air inlet and a clean air outlet. The handheld extraction cleaner may further include a suction nozzle carried by the body and defining the dirty air inlet. The handheld extraction cleaner may further include a suction motor received within a motor housing and a recovery tank with both being carried by the body and fluidly coupled with the suction nozzle. The handheld extraction cleaner may further include at least one exhaust vent disposed in the body and defining the clean air outlet and at least one baffle disposed between the motor housing and the at least one exhaust vent, with the at least one baffle being fluidly coupled with the working air path to dampen noise.

Disclosed herein is a handheld extraction cleaner. The handheld extraction cleaner may include a unitary body having a dirty air inlet and a clean air outlet with a working air path through the body therebetween. The handheld extraction cleaner may further include a suction nozzle defining at least a portion of the dirty air inlet and a suction motor fluidly coupled with the suction nozzle. The handheld extraction cleaner may further include a fan housing configured to at least partially house a fan coupled with the suction motor and a motor housing configured to at least partially house the suction motor, with the motor housing being fluidly coupled with the working air path through one or more openings in the fan housing. The handheld extraction cleaner may further include at least one baffle integrally formed with the motor housing to dampen noise.

DETAILED DESCRIPTION

The present disclosure relates generally to extraction cleaners, and more particularly to a portable, handheld extraction cleaner which applies cleaning fluid to a surface and then extracts the applied fluid therefrom.

Figure 1:
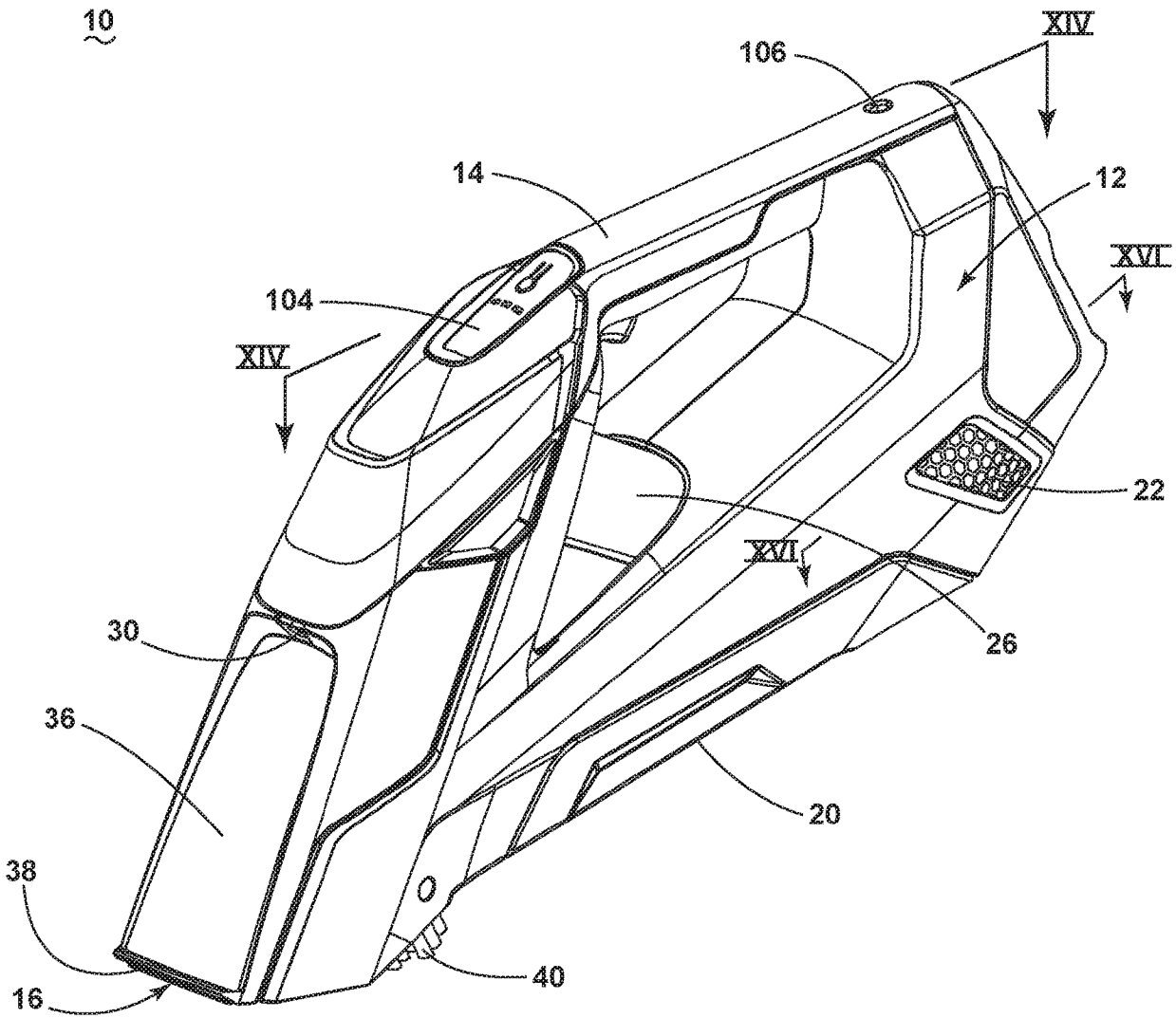
FIG. 1 is a perspective view of a handheld extraction cleaner according to one aspect of the present disclosure.

FIG. 1 is a perspective view of a handheld extraction cleaner 10 10 according to one aspect of the present disclosure. As illustrated herein, the extraction cleaner 10 is adapted to be handheld and portable, and can be easily carried or conveyed by hand. The hand-carriable extraction cleaner 10 can have a unitary body 12 provided with a carry handle 14 attached to the unitary body 12, and is small enough to be transported by one user (i.e. one person) to the area to be cleaned.

For purposes of description related to the figures, the terms "upper," "lower," "right," "left," "rear," "front," "vertical," "horizontal," "inner," "outer," and derivatives thereof shall relate to the present disclosure as oriented in FIG. 1 from the perspective of a user behind the extraction cleaner 10, which defines the rear of the extraction cleaner 10, while the extraction cleaner 10 sits on a substantially horizontal surface. However, it is to be understood that the present disclosure may assume various alternative orientations, except where expressly specified to the contrary.

The handheld extraction cleaner 10 comprises a unitary body 12 or housing that carries the various functional systems of the extraction cleaner 10, including a fluid delivery system for storing cleaning fluid and delivering the cleaning fluid to the surface to be cleaned and a recovery system removing the spent cleaning fluid and debris from the surface to be cleaned and storing the spent cleaning fluid and debris.

The recovery system can include a working air path through the body 12, and may include a dirty air inlet and a clean air outlet. The working air path can be formed by, among other elements, a suction nozzle 16 defining the dirty air inlet, a suction source 18 (FIG. 6) in fluid communication with the suction nozzle 16 for generating a working air stream, a recovery tank 20 for separating and collecting fluid and debris from the working airstream for later disposal, and exhaust vents 22 in the housing defining the clean air outlet. The recovery system can further include a separator 24 (FIG. 7) for separating fluid and entrained debris from the working airstream. The separator 24 can be formed in a portion of the recovery tank 20, or, as illustrated herein, can be separate from the recovery tank 20. The separated fluid and debris can be collected in the recovery tank 20. One example of a suitable separator 24 is disclosed in U.S. Pat. No. 7,225,503, issued Jun. 5, 2007, which is incorporated herein by reference in its entirety. Other examples of suitable separators are disclosed in U.S. Pat. No. 6,189,178, issued Feb. 20, 2001, and U.S. Pat. No. 6,968,593, issued Nov. 29, 2005, both of which are incorporated herein by reference in their entirety.

The fluid delivery system can include a supply reservoir or tank 26 for storing a supply of fluid. The fluid can comprise one or more of any suitable cleaning fluids, including, but not limited to, water, compositions, concentrated detergent, diluted detergent, etc., or mixtures thereof. For example, the fluid can comprise a mixture of water and concentrated detergent. The fluid delivery system can further comprise a flow control system 28 for controlling the flow of fluid from the supply tank 26 to at least one fluid distributor 30. Optionally, a heater (not shown) can be provided for heating the cleaning fluid prior to delivering the cleaning fluid to the surface to be cleaned. In yet another example, cleaning fluid can be heated using exhaust air from a motor-cooling pathway for the suction source 18.

Figure 2:
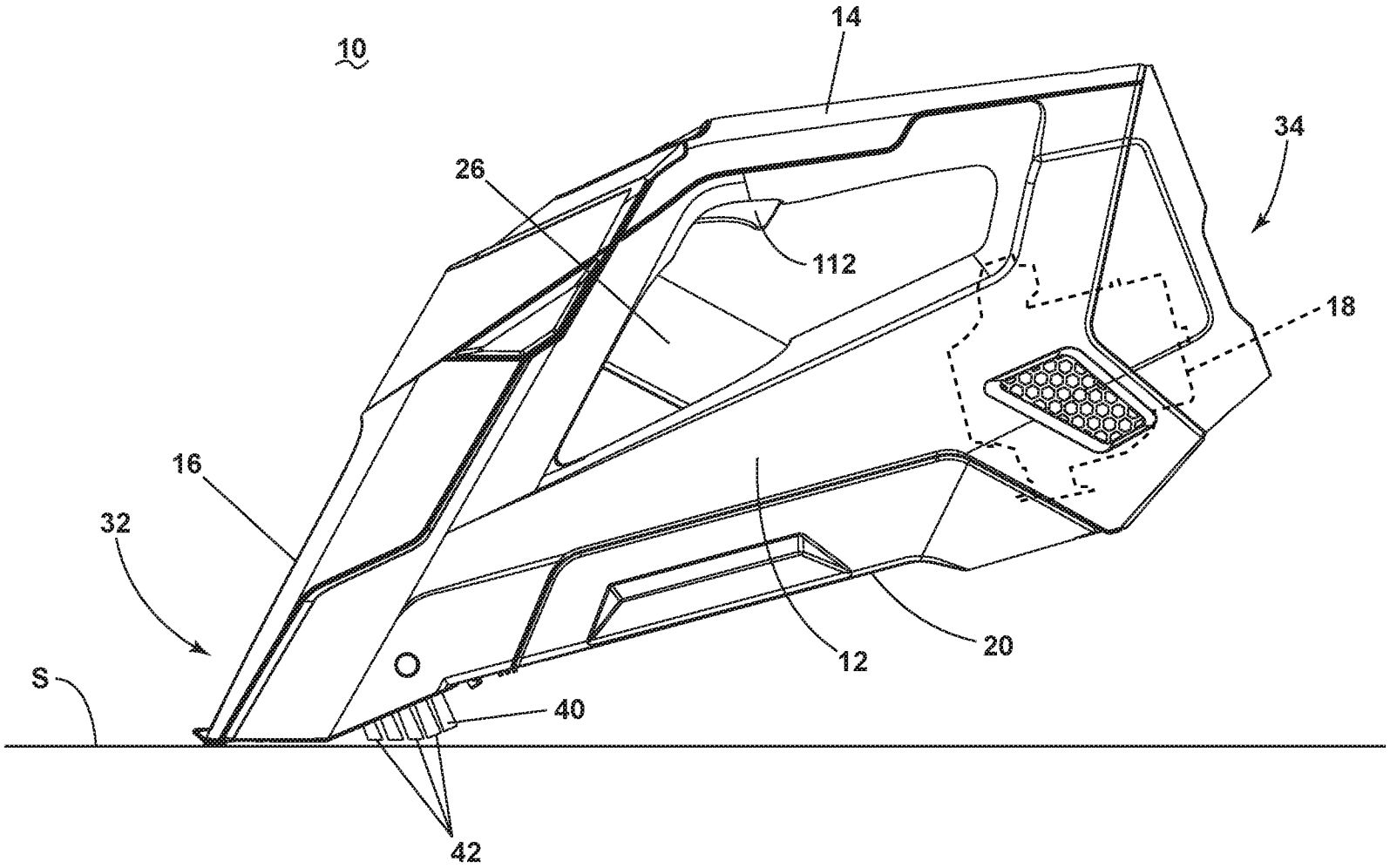
FIG. 2 is a side view of the handheld extraction cleaner from FIG. 1 in one example of a normal use position.

FIG. 2 is a side view of the handheld extraction cleaner 10 from FIG. 1, shown in one example of an operative or normal use position relative to a surface S to be cleaned. In the operative or normal use position, the extraction cleaner 10 is held with the suction nozzle 16 generally adjacent the surface to be cleaned. The suction nozzle 16 is provided at a forward end 32 of the housing 12 while the suction source 18 is provided at a rearward end 34 of the housing 12. The supply tank 26 can be provided forwardly of the suction source 18, and rearwardly of the suction nozzle 16. The recovery tank 20 can be provided on the housing 12 below the supply tank 26 and suction source 18. The carry handle 14 extends above the tanks 20, 26 and suction source 18, with the recovery tank 20 substantially centered below the hand grip of the carry handle 14. This arrangement of component parts of the extraction cleaner 10 offers a balanced weight in hand for the user, and a comfortable carrying and operational position.

Figure 3:
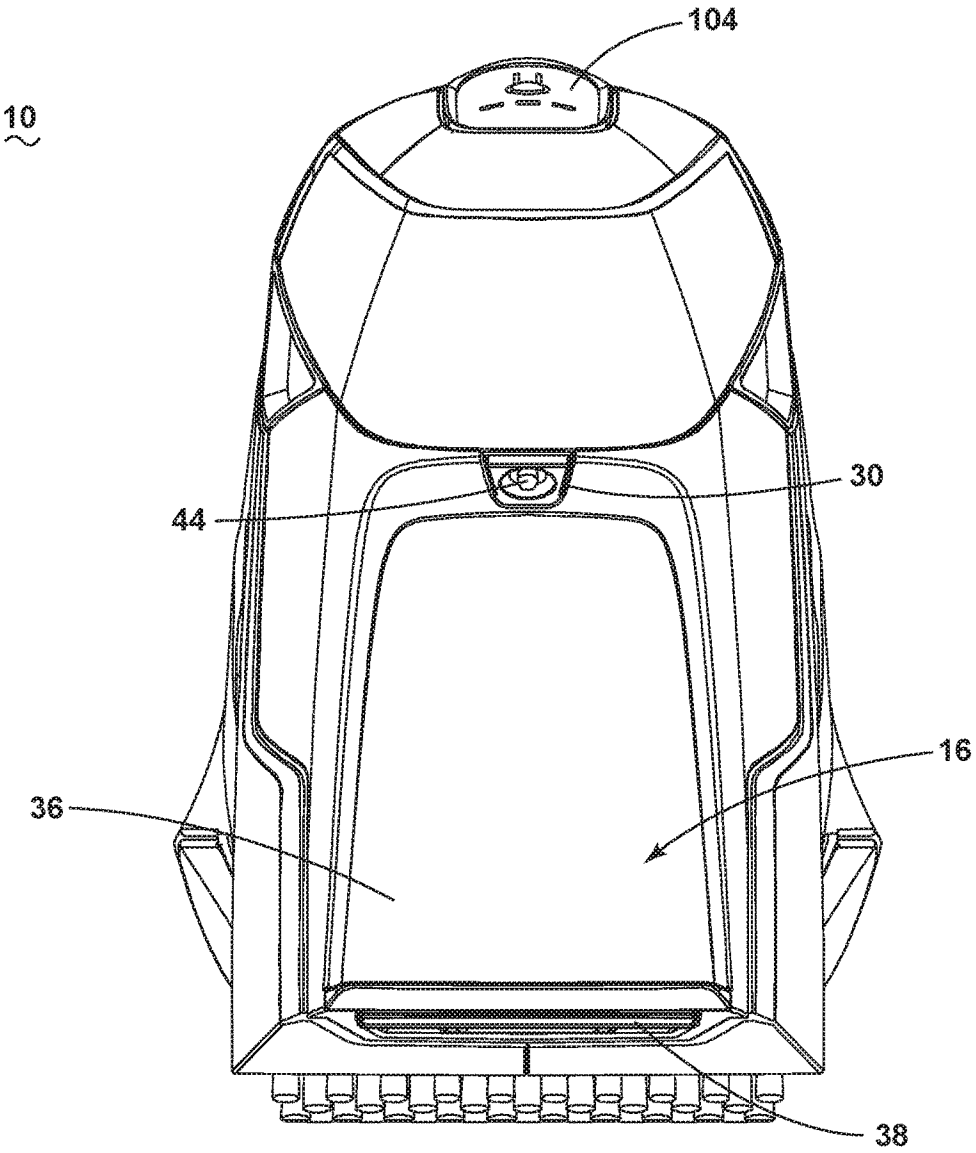
FIG. 3 is a front view of the handheld extraction cleaner from FIG. 1.

FIG. 3 is a front view of the handheld extraction cleaner 10 from FIG. 1. The suction nozzle 16 includes a nozzle cover 36 having a nozzle inlet 38 at a lower end thereof. The nozzle inlet 38 can be angled, such that in the normal use position shown in FIG. 2, the handheld extraction cleaner 10 is held at an angle while the nozzle inlet 38 is generally horizontal to the surface to be cleaned.

An agitator 40 can be provided adjacent to the suction nozzle 16 for agitating the surface to be cleaned so that the debris is more easily ingested into the suction nozzle 16. As shown, the agitator 40 comprises a stationary brush assembly comprising a plurality of bristles 42 which project below the nozzle inlet 38 of the suction nozzle 16. The bristles 42 may also be angled, such that in the normal use position shown in FIG. 2, the handheld extraction cleaner 10 is held at an angle at least some of the bristles 42 contact the surface to be cleaned. Other bristles 42 can be oriented along a different plane, so that the user can selectively bring more or less of the bristles 42 into contact with the surface to be cleaned by pivoting the carry handle 14.

Some other examples of suitable agitators include, but are not limited to, horizontally-rotating brushrolls, vertically-rotating brushrolls, or additional stationary brushes. In addition, other than bristles 42, the agitator 40 can include a scrubbing material, such as a non-woven scrubber, or a pad constructed of an open cell foam material and a netting that encircles a substantial portion of the pad, or a plurality of elongated teeth or nubs. Multiple agitators can be provided with the handheld extraction cleaner 10, and can be interchangeably mounted to the housing. Other examples of suitable agitators are disclosed in previously cited U.S. Pat. No. 7,225,503, incorporated above, and U.S. Pat. No. 6,658,693, issued Dec. 9, 2003, and which is incorporated herein by reference in its entirety.

The fluid distributor 30 can include at least one distributor outlet 44 for delivering fluid to the surface to be cleaned. The at least one distributor outlet 44 can be positioned to deliver fluid directly to the surface to be cleaned, outwardly in front of the suction nozzle 16 so that user can clearly see where fluid is being applied. Alternately, the fluid distributor 30 can deliver fluid onto the agitator 40. The at least one distributor outlet 44 can comprise any structure, such as a nozzle or spray tip; multiple outlets can also be provided. As illustrated in FIG. 3, the distributor 30 can comprise one spray tip provided on the front of the suction nozzle 16 which distributes cleaning fluid to the surface to be cleaned in front of the suction nozzle 16 from the distributor outlet 44.

Figure 4:
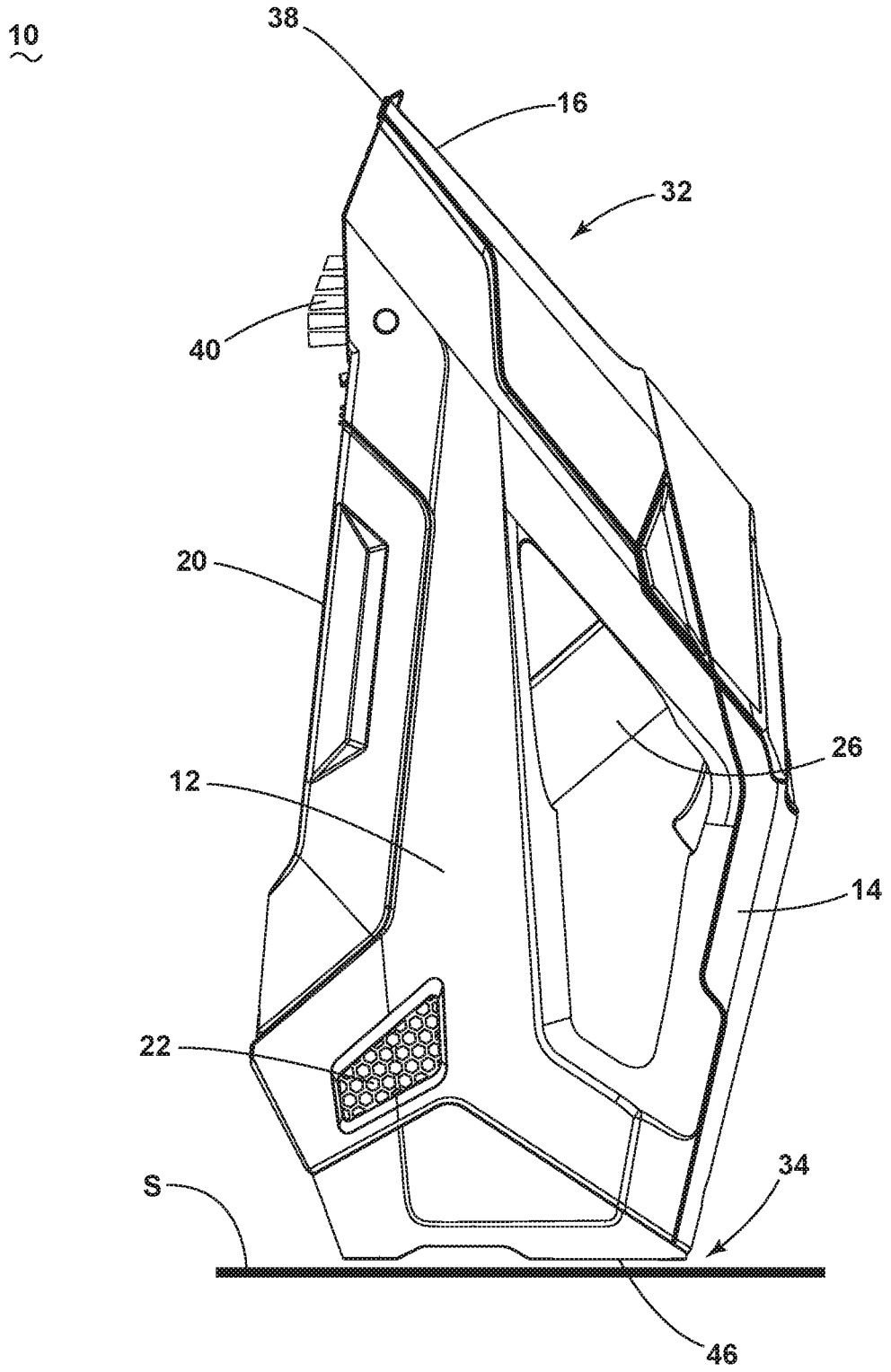
FIG. 4 is a side view of the handheld extraction cleaner from FIG. 1, with the handheld extraction cleaner in a self-standing position.

FIG. 4 is a side view of the handheld extraction cleaner 10 from FIG. 1, with the handheld extraction cleaner 10 in a self-standing position. The rearward end 34 of the housing 12 can include a substantially flat back end 46 configured to support the handheld extraction cleaner 10 in the self-standing position on surface S. As shown, the extraction cleaner 10 can rest on the back end 46 in a vertical position. This can be helpful, because a user can set the extraction cleaner 10 down in a stable position without having the agitator 40 or suction nozzle 16 in contact with the surface S, and any residual fluid within the suction nozzle 16 or recovery tank 20 will not leak out through the suction nozzle inlet 38. In the self-standing position, the forward end 32 of the housing 12 faces upwardly, or away from the surface S. As such, the suction nozzle 16 is generally opposite the surface S and also faces upwardly, or away from the surface S.

Figure 5:
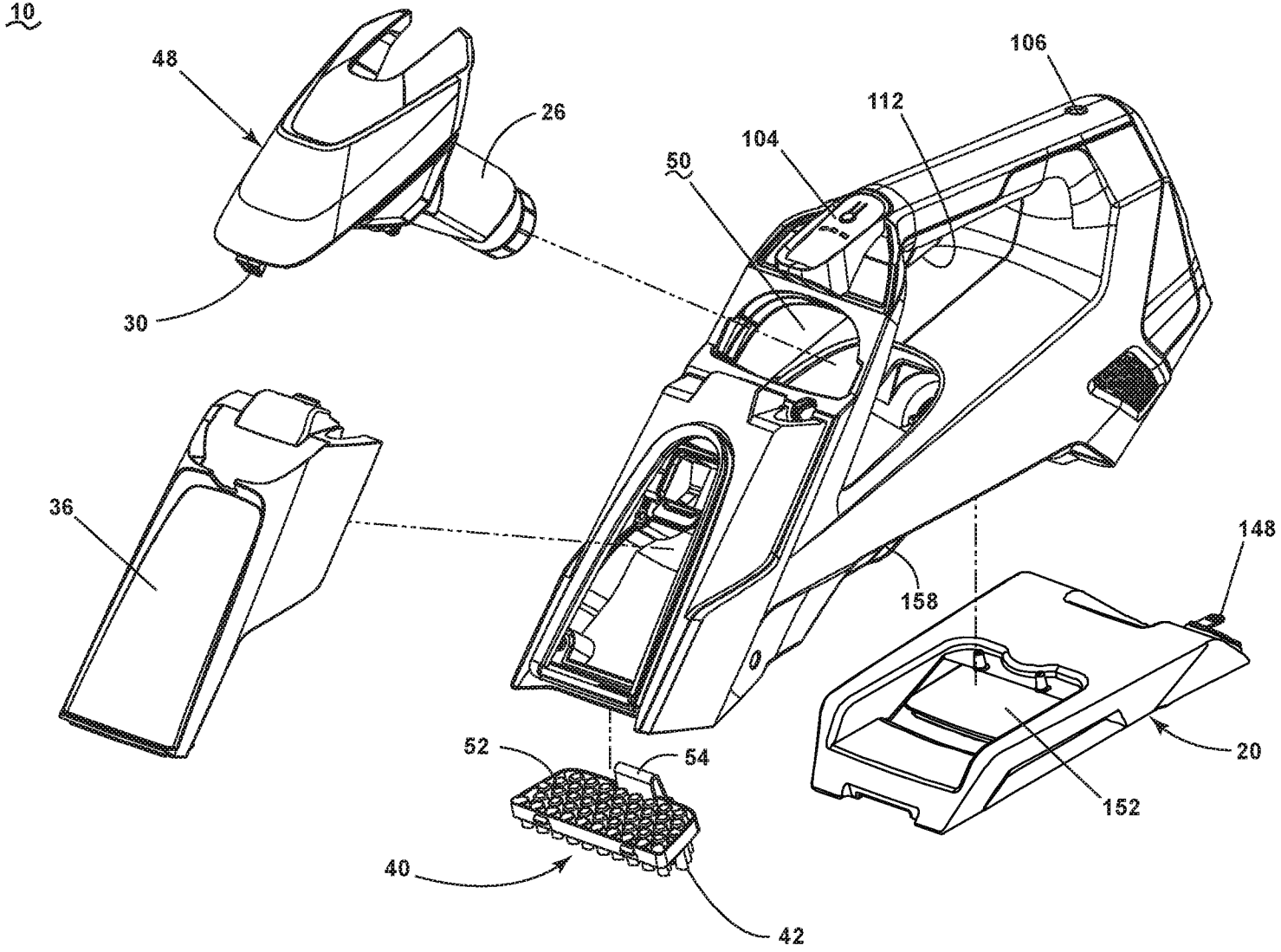
FIG. 5 is an exploded view of the handheld extraction cleaner from FIG. 1.

FIG. 5 is an exploded view of the handheld extraction cleaner 10 from FIG. 1. The supply tank 26 and the fluid distributor 30 can be provided as a modular fluid supply assembly 48. The fluid supply assembly 48 can be removable as a modular unit from the housing 12. A receptacle 50 for mounting the fluid supply assembly 48 can be provided in the housing 12, and the fluid supply assembly 48 can be mounted generally below the carry handle 14 and above the suction nozzle 16. The receptacle 50 can be provided closer to the forward end 32 of the housing 12 than the rearward end 34, and can comprise an opening positioned between a forward end of the carry handle 14 and the upper end of the suction nozzle 16.

In the present example, the agitator 40 includes a brush base 52 from which the bristles 42 project. A mounting latch 54 can be provided on the brush base 52, and can engage a latch receptacle 56 (FIG. 14) on the bottom of the housing 12 to retain the agitator 40 within a brush receptacle 58 on the bottom of the housing 12 and adjacent the latch receptacle. The mounting latch 54 shown herein is a biased bearing retainer that frictionally engages the latch receptacle 56.

Figure 6:
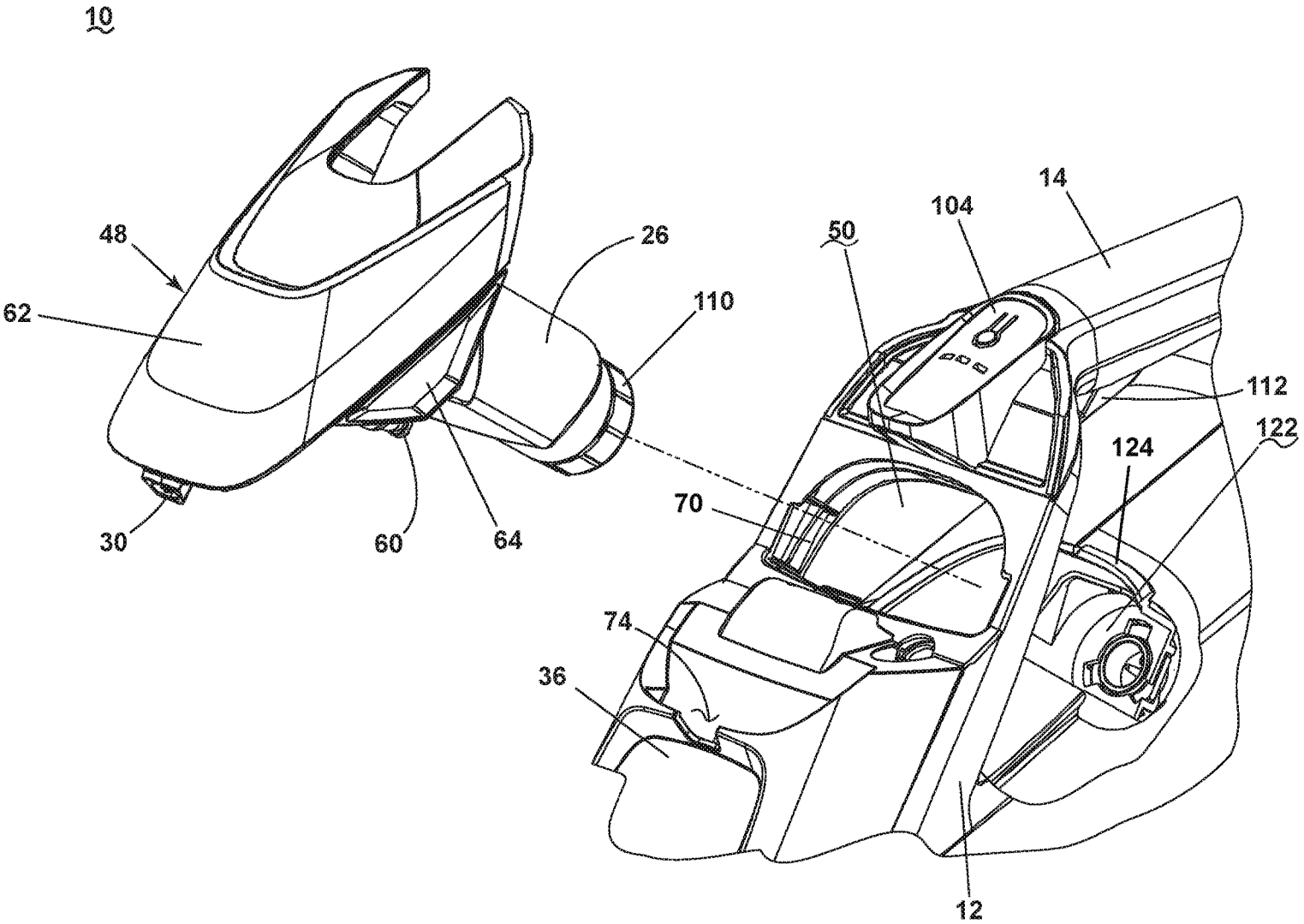
FIG. 6 is a close-up view of the handheld extraction cleaner from FIG. 1 showing a fluid supply assembly removed from the housing of the handheld extraction cleaner.

FIG. 6 is a close-up view of the handheld extraction cleaner 10 from FIG. 1 showing the modular fluid supply assembly 48 removed from the housing 12 of the handheld extraction cleaner 10. The modular fluid supply assembly 48 includes, in addition to the supply tank 26 and the fluid distributor 30, a fluid connector 60 for coupling the supply tank 26 with the fluid distributor 30 and a cover 62. The fluid connector 60 couples with a portion of the fluid delivery system within the housing 12, as described in further detail below. The cover 62 provides a mount for the supply tank 26, fluid distributor 30, and fluid connector 60, and each sidewall of the cover 62 can include a depression 64 to facilitate handling the fluid supply assembly 48 during removal and installation thereof with respect to the housing 12. The cover 62 can have a decorative aspect to create a flush and aesthetic appearance with the housing 12 and carry handle 14 when the modular fluid supply assembly 48 is mounted to the housing 12 of the handheld extraction cleaner 10.

The cover 62 can further include a lock to secure the modular fluid supply assembly 48 to the housing 12. The lock can include retention detents 68 (FIG. 9) on opposing sides of the cover 62 and detent receivers 70 on the housing 12, which may be at the perimeter of the receptacle 50. The detents 68 can be provided on the cover 62 adjacent to the depressions 64 such that pressing the depressions 64 will flex the detents 68 out of the receivers 70. To mount the modular fluid supply assembly 48 to the housing 12 of the handheld extraction cleaner 10, the supply tank 26 can be inserted through the receptacle 50, with the detents 68 fitted into the detent receivers 70. The front nozzle cover 36 can optionally be provided with a receiver 74 for seating the fluid distributor 30, with the distributor 30 automatically seated in the receiver 74 when the modular fluid supply assembly 48 is mounted to the housing 12.

Figure 7:
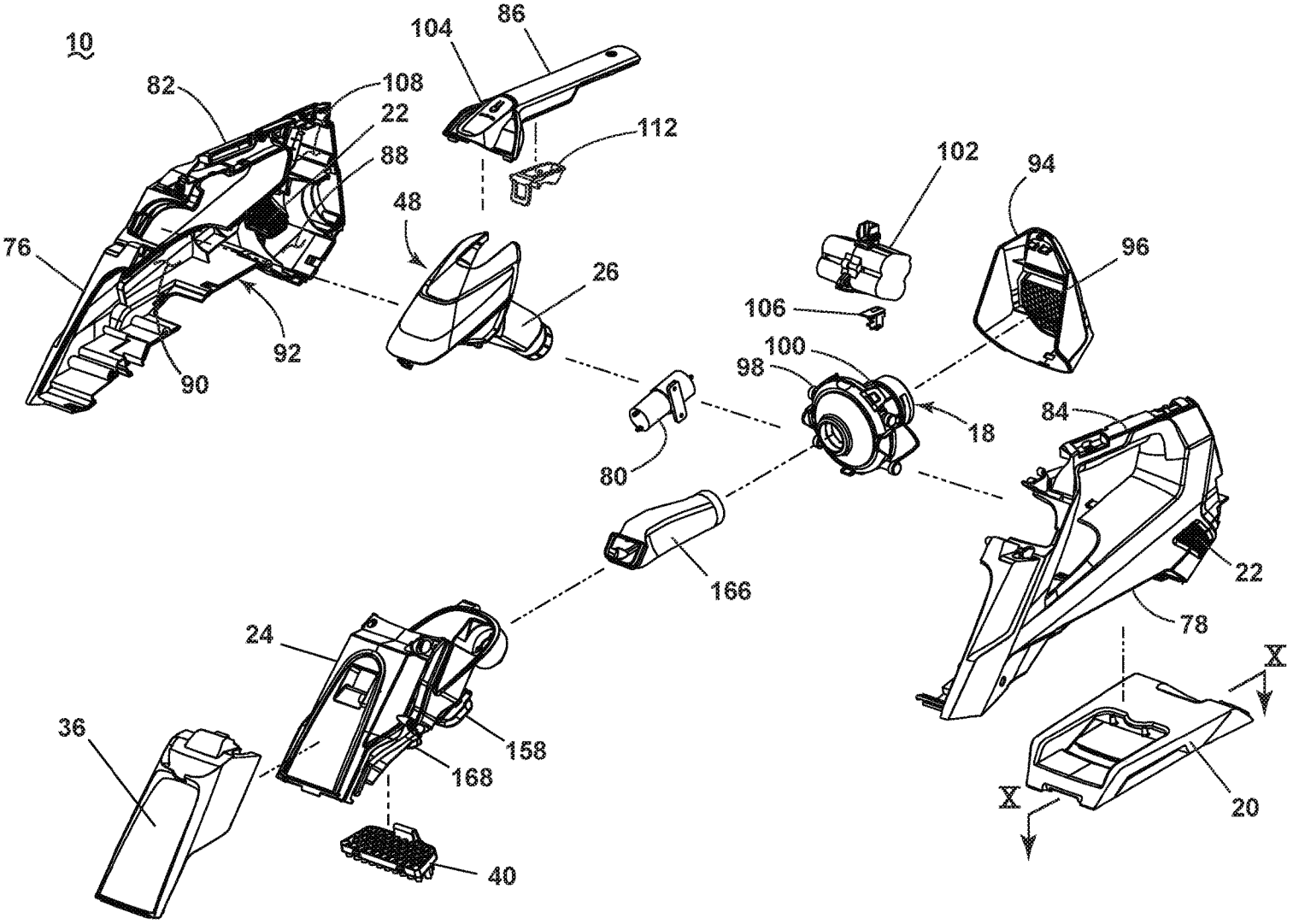
FIG. 7 is another exploded view of the handheld extraction cleaner from FIG. 1.

FIG. 7 is another exploded view of the handheld extraction cleaner 10 from FIG. 1. The housing 12 shown herein includes a first shell half 76 and a second shell half 78 that are secured together to define a cavity that houses components such as the suction source 18 and a pump 80. Each shell half 76, 78 also includes an integrally molded handle half 82, 84. A molded grip 86 can be attached to a top portion of the assembled handle halves 82, 84. The shell halves 76, 78 can further have molded features which define a suction source chamber 88 which receives the suction source 18, a pump chamber 90 which receives the pump 80, and a recovery tank receptacle 92 which receives the recovery tank 20. A back cover 94 can be attached to a rear portion of the assembled handle halves 82, 84, and can include a motor cooling air inlet 96 in fluid communication with the suction source chamber 88, and through which ambient air for cooling the suction source 18 can be drawn.

The suction source 18, which may be a motor/fan assembly, is provided in fluid communication with the recovery tank 20. As shown, the motor/fan assembly 18 includes a fan/impeller section 98 and a motor section 100 which are housed in the suction source or motor/fan chamber 88.

The motor/fan assembly 18 can be electrically coupled to a power source 102, such as a battery, battery pack, or by a power cord plugged into a household electrical outlet. A suction power switch 104 between the motor/fan assembly 18 and the power source 102 can be selectively closed by the user, thereby activating the motor/fan assembly 18. The power switch 104 can comprise an on/off button provided on a front end of the carry handle 14. Other electrical components of the handheld extraction cleaner 10 can also be electrically coupled to the power source 102, such as the pump 80.

In the present example, the power source 102 comprises a rechargeable battery or battery pack. A charging port 106 can be provided on the housing 12 and can be electrically coupled with the battery pack 102. In the illustrated example, the charging port 106 is provided on a rear end of the carry handle 14 and is accessible through the grip 86. A storage and recharging cradle (not shown) can mount the extraction cleaner 10 when not in use, and can include a recharging connector that couples with the charging port 106, an electrical cord electrically connected between the recharging connector and an AC/DC transformer that can be plugged into an electrical outlet for supplying DC recharging current to the battery pack 102.

A battery chamber 108 for the battery pack 102 can be defined by molded features in the shell halves 76, 78 forming the housing 12. The charging port 106 can also be accommodated in the battery chamber 108. Optionally, the battery chamber 108 can be inaccessible to the user of the handheld extraction cleaner 10, such that a user cannot access the battery pack 102. The battery chamber 108 can be located at the rearward end 34 of the housing 12, above the motor/fan chamber 88 and rearward of the handle 14.

In one configuration, the flow control system 28 of the fluid delivery system can comprise a pump 80 which pressurizes the system and a flow control valve 110 which at least partially controls the delivery of fluid to the at least one fluid distributor 30. A fluid distribution switch mechanism or actuator 112 can be provided to actuate the flow control system 28 and dispense fluid to the distributor 30. The actuator 112 can be operably coupled to the pump 80 such that pressing the actuator 112 will activate the pump 80. In one example, the pump 80 can be a centrifugal pump. In another example, the pump 80 can be a solenoid pump. In still another example, the pump 80 can be a manually actuated spray pump. Alternatively, the valve 110 can be coupled with the actuator 112. In yet another configuration of the fluid delivery system, the pump 80 can be eliminated and the flow control system 28 can comprise a gravity-feed system having a valve fluidly coupled with an outlet of the supply tank 26, whereby when valve is open, fluid will flow under the force of gravity to the distributor 30. However, the use of a pump offers the advantage of orienting the supply tank 26 and fluid distributor 30 relative to other components on the body 12 to provide a more balanced weight in hand.

The fluid distribution switch mechanism or actuator 112 may comprise a trigger provided on the housing 12. The trigger 112 can conveniently be provided on an underside of the handle 14, i.e. opposite the molded grip 86, at a forward end thereof, for operation of the trigger 112 by an index finger of the user's hand that is gripping the carry handle 14.

Figure 8:
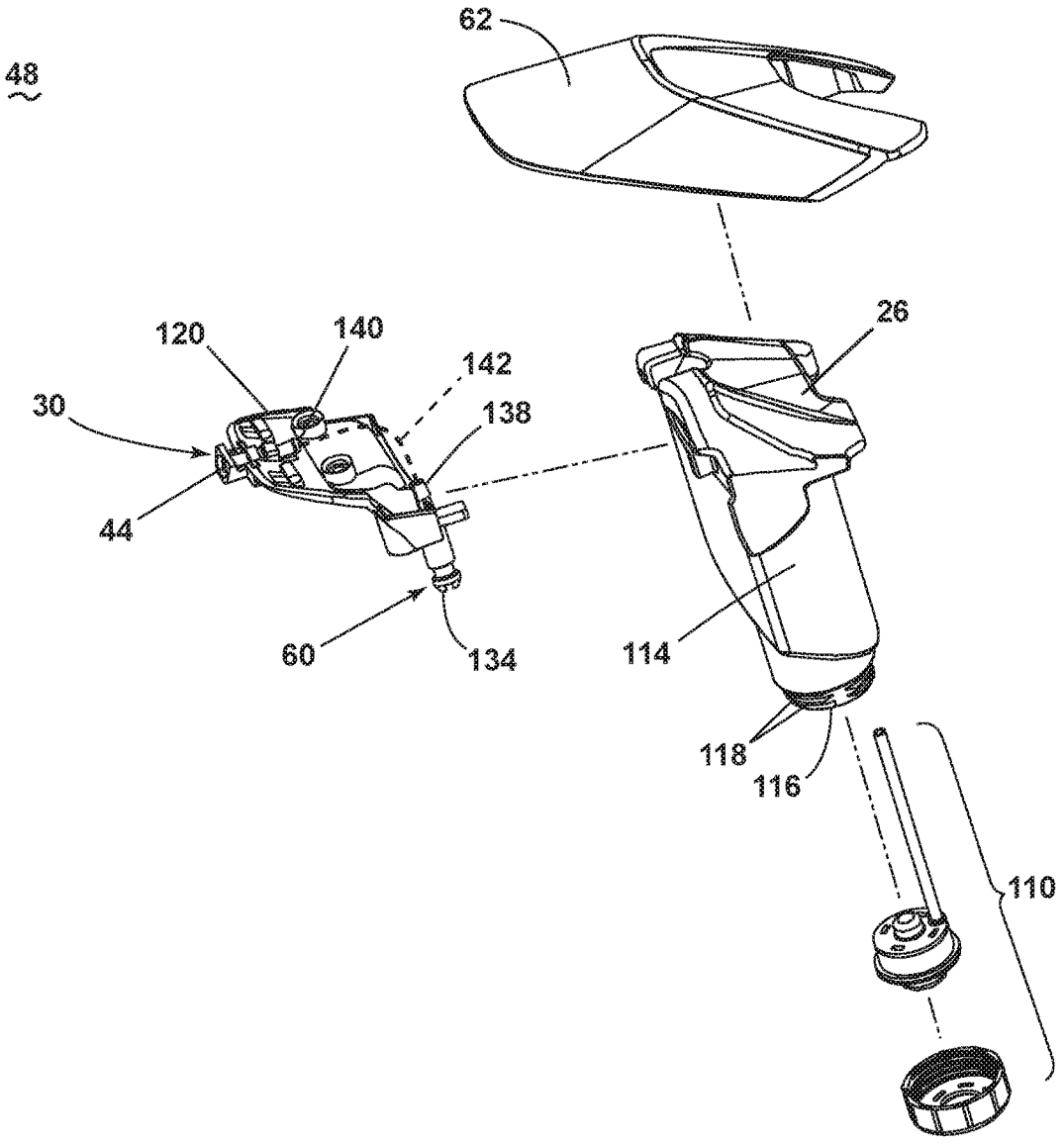
FIG. 8 is an exploded view of a supply tank of the handheld extraction cleaner from FIG.

FIG. 8 is an exploded view of the fluid supply assembly 48 of the handheld extraction cleaner 10 from FIG. 1. The supply tank 26 comprises a hollow tank body 114 with an outlet opening that is defined by a neck 116 having external threads 118. The flow control valve 110 is provided as a cap and valve assembly adapted to be mounted on the neck 116 to close the outlet opening of the tank body 114 and regulate the flow of fluid therethrough. One example of a suitable cap and valve assembly is disclosed in U.S. Pat. No. 6,125,498, issued Oct. 3, 2000, which is incorporated herein by reference in its entirety. Another example is disclosed in U.S. Pat. No. 7,073,226, issued Jul. 11, 2006, which is incorporated herein by reference in its entirety.

A bracket 120 which holds the fluid distributor 30, i.e. spray tip, and the fluid connector 60 can be positioned between the cover 62 and the supply tank 26. The bracket 120 is attached to the tank body 114 via fasteners, such as screws (not shown). As discussed above, the fluid supply assembly 48 is a modular unit, such that when the user removes the supply tank 26 from the housing 12, such as to fill it with cleaning solution, the spray tip 30 and fluid connector 60 are removed as well, along with the cover 62.

Figure 9:
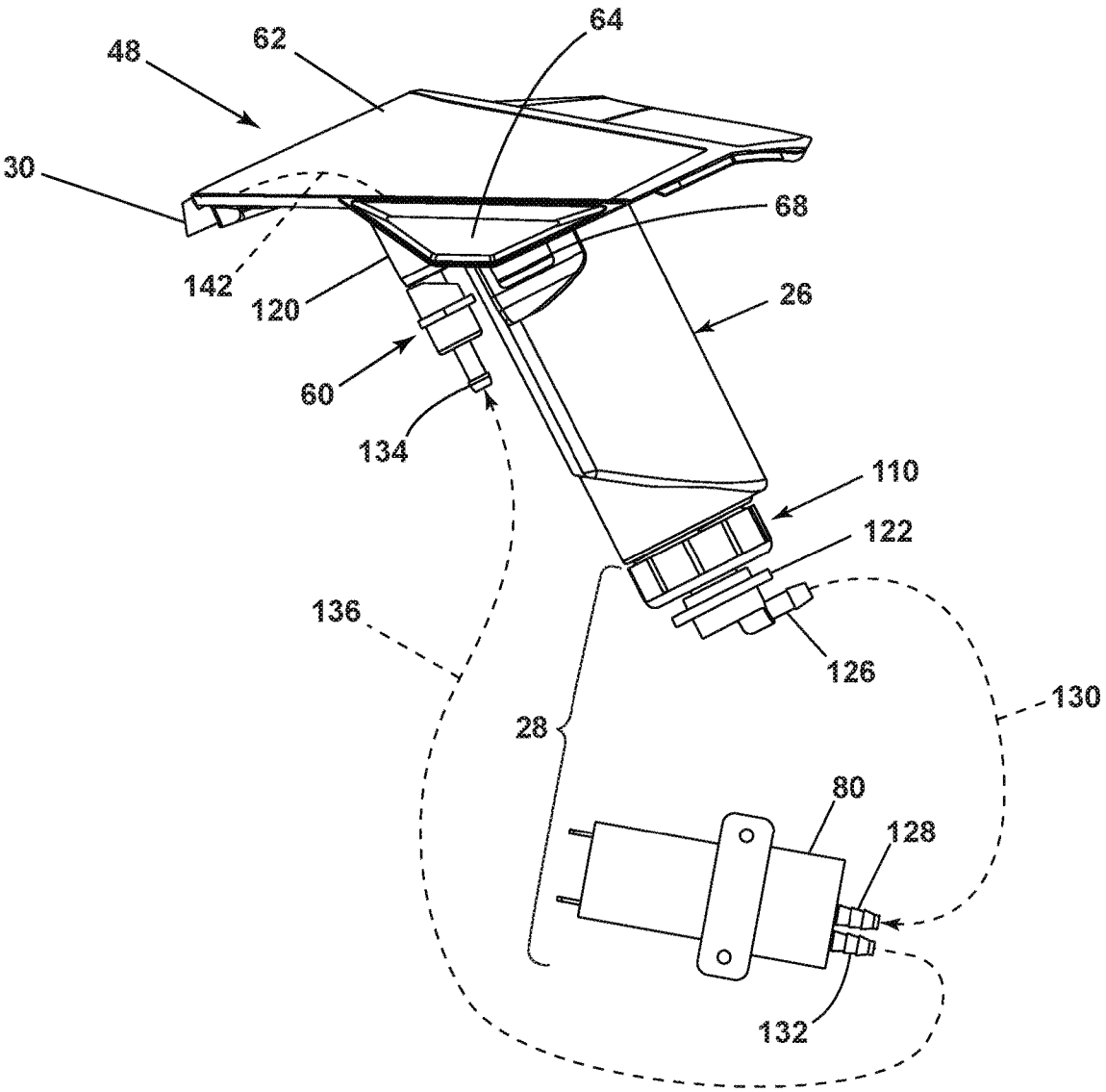
FIG. 9 is a view showing a fluid delivery system of the handheld extraction cleaner from FIG. 1.

FIG. 9 is a view showing the fluid delivery system of the handheld extraction cleaner 10 from FIG. 1. As discussed above, the fluid delivery system illustrated herein includes the fluid supply assembly 48, which includes the supply tank 26 and the cap and valve assembly 110, the pump 80, the fluid connector 60, and the spray tip 30. The fluid delivery system further includes a receiver 122 which places the supply tank 26 in fluid communication with the pump 80 when the fluid supply assembly 48 is installed on the housing 12. The cap and valve assembly 110 can be configured to automatically open when seated in the receiver 122.

Figure 11:
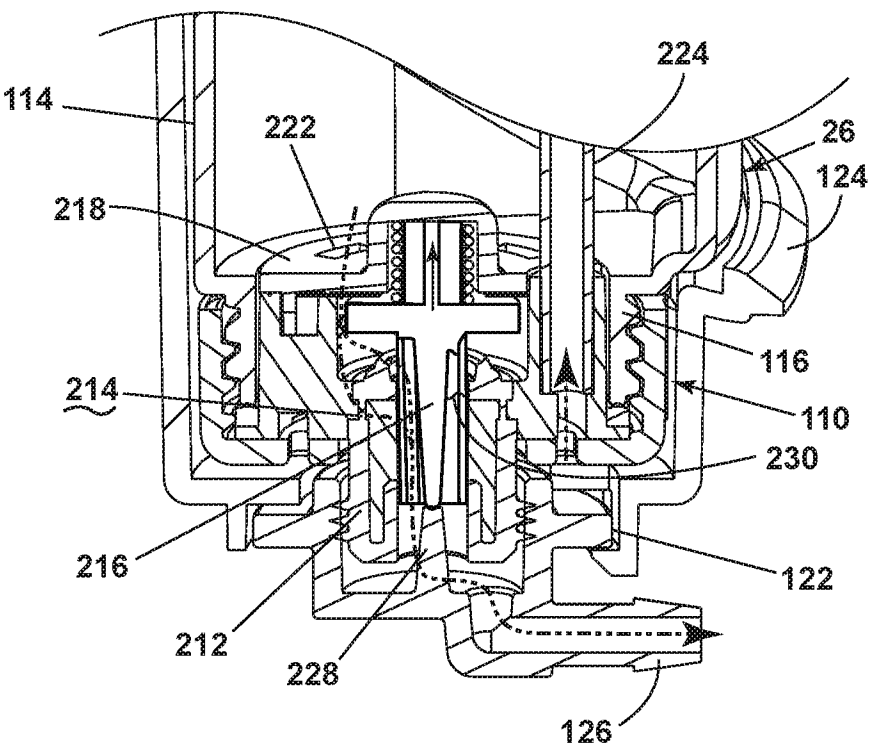
FIG. 11 is a sectional view through is a sectional view similar to FIG. 10, where the supply tank is seated within a cavity and coupled with a receiver and the valve assembly is in an open position.
Figure 10:
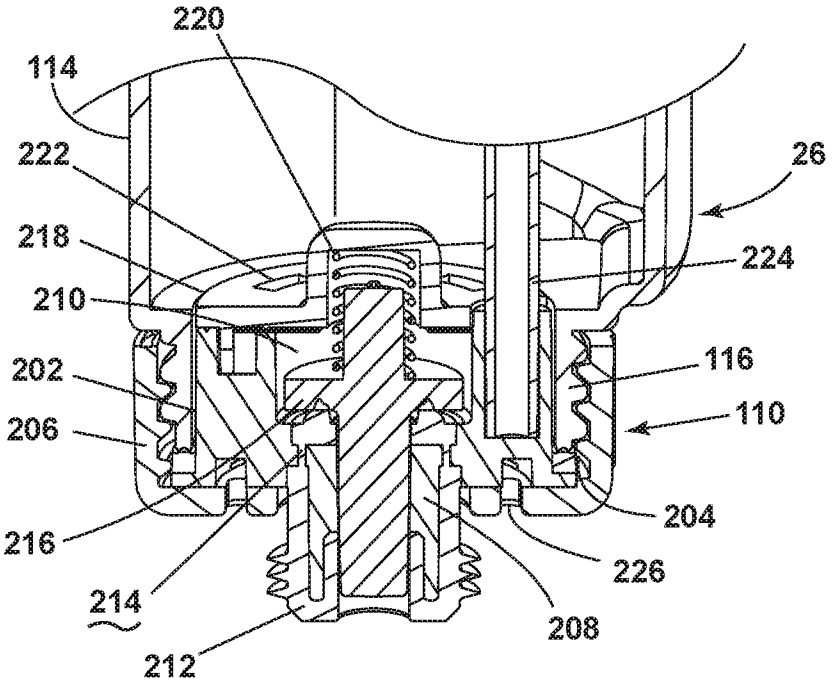
FIG. 10 is a sectional view through a valve assembly of a supply tank of the handheld extraction cleaner from FIG. 1, where the valve assembly is in a closed position.

Referring to FIGS. 10-11, the cap and valve assembly 110 is adapted to be mounted in the outlet opening of the supply tank 26 and includes a valve body 202 received within the neck 116. A gasket 204 can be installed between the neck 116 and an annular flange of the valve body 202. An outlet cap 206 can carry the valve body 202 and is adapted to be threaded onto the neck 116 of the tank body 114.

The valve body 202 is hollow with a downwardly extending connector boss 208 and defines a fluid reservoir 210 which can hold fluid when the valve assembly 110 is closed as shown in FIG. 10 to prime the pump 80. A flexible rubber seal 212 fits around the boss 208 and is adapted to engage the receiver 122 when the supply tank 26 is installed on the extraction cleaner 10. The seal 212 preferably has a plurality of apertures 214 therein to permit the flow of fluid from the reservoir 210 therethrough.

The cap and valve assembly 110 further comprises a spring-loaded plunger 216 carried by the valve body 202 and held in position by a retaining plate 218. The plunger 216 is biased by a spring 220 against the seal 212 to the closed position shown in FIG. 10. The retaining plate 218 preferably has a plurality of apertures 222 therein to permit the flow of fluid from the tank body 114 therethrough.

The valve assembly 110 further comprises a vent tube 224 fluidly connected to ambient air outside of the receiver 122 through an opening 226 in the cap 206, and allows air to vent into the tank body 114 to displace dispensed liquid. As liquid is drawn from the tank body 114, atmospheric air enters the tank body 114 to relieve the vacuum developed as the cleaning solution is dispensed, thereby equalizing pressure within the tank body 114.

Referring to FIG. 11, when supply tank 26 is mounted on housing 12 and nested in the receiver 122 and tank cavity 124, a post 228 in the receiver 122 forces the plunger 216 upwardly. Liquid flows through the apertures 222 in the retaining plate 218 and through a gap 230 between the upper portion of the seal 212 and the plunger 216, as well as through the apertures 214 in the side of the seal 212, and through an open bottom of the seal 212 into the receiver 122. The vent tube 224 allows air to vent into the tank body 114 to displace the dispensed liquid.

With reference to FIG. 6, the receiver 122 can be provided within a tank cavity 124 provided on the housing 12. The tank cavity 124 can be formed as an open recess in the housing 12 for accessing the receiver 122 and receiving at least a lower portion of the supply tank 26. The tank cavity 124 can be generally located beneath the handle 14 and rearward of the receptacle, such that the supply tank 26 is oriented at an angle when mounted on the housing 12. This arrangement can provide a larger supply tank 26 within a compact housing 12, to provide a more balanced weight in hand while also providing a larger volume of available cleaning fluid.

In the example shown, the tank cavity 124 can be offset with respect to a centerline the housing 12 or a centerline of the handle 14; for example, the tank cavity 124 can be provided within the second shell half 78. The receiver 122 and valve assembly 110 on the supply tank 26 can be similarly offset.

To mount the modular fluid supply assembly 48 to the housing 12 of the handheld extraction cleaner 10, the supply tank 26 can be inserted through the receptacle 50 and seated in the tank cavity 124, with the valve assembly 110 docking with the receiver 122. The cover 62 can nest in a mating recess on the housing 12 with retention detents 68 for locking the modular fluid supply assembly 48 to the housing 12, and the spray tip 30 can seat within the receiver 74.

With reference to FIG. 9, an outlet 126 of the receiver 122 is in fluid communication with an inlet 128 of the pump 80, and a conduit 130 can be provided in the housing 12 to connect the receiver outlet 126 and pump inlet 128. An outlet 132 of the pump 80 is in fluid communication with an inlet 134 of the fluid connector 60, and a conduit 136 can be provided in the housing 12 to connect the pump outlet 132 and fluid connector inlet 134. An outlet 138 of the fluid connector 60 is in fluid communication with an inlet 140 of the spray tip 30 (FIG. 8), and a conduit 142 can be provided in the housing 12 to connect the fluid connector outlet 138 and spray tip inlet 140. The conduits 130, 136, 142 are indicated in phantom line in FIGS. 8-9, but it is understood that any of the conduits 130, 136, 142 can comprise flexible tubing or molded rigid conduits.

When the fluid supply assembly 48 is installed on the housing 12, the cap and valve assembly 110 on the supply tank 26 is partially seated in the tank cavity 124 and coupled with the receiver 122, while the cover 62 abuts the housing 12 and suction nozzle 16 to seat the spray tip 30 in the spray tip receiver 74 on the nozzle cover 36 and couples the fluid connector 60 with the pump 80. In the installed position, the receiver 122 pushes the valve of the cap and valve assembly 110 open to thereby permit fluid to flow from the tank 26 and into the conduit connected with the pump 80, where the fluid can be pumped though the fluid connector 60 to the spray tip 30 upon actuation of the trigger 112 provided on the housing 12 to activate the pump 80. The fluid connector 60 can further be provided with O-ring seals to provide a fluid-tight fit with a mating connector (not shown) of the conduit 136. Similarly, the outlet seal 212 of the cap and valve assembly 110 can have a fluid-tight fit with the receiver 122.

Figure 12:
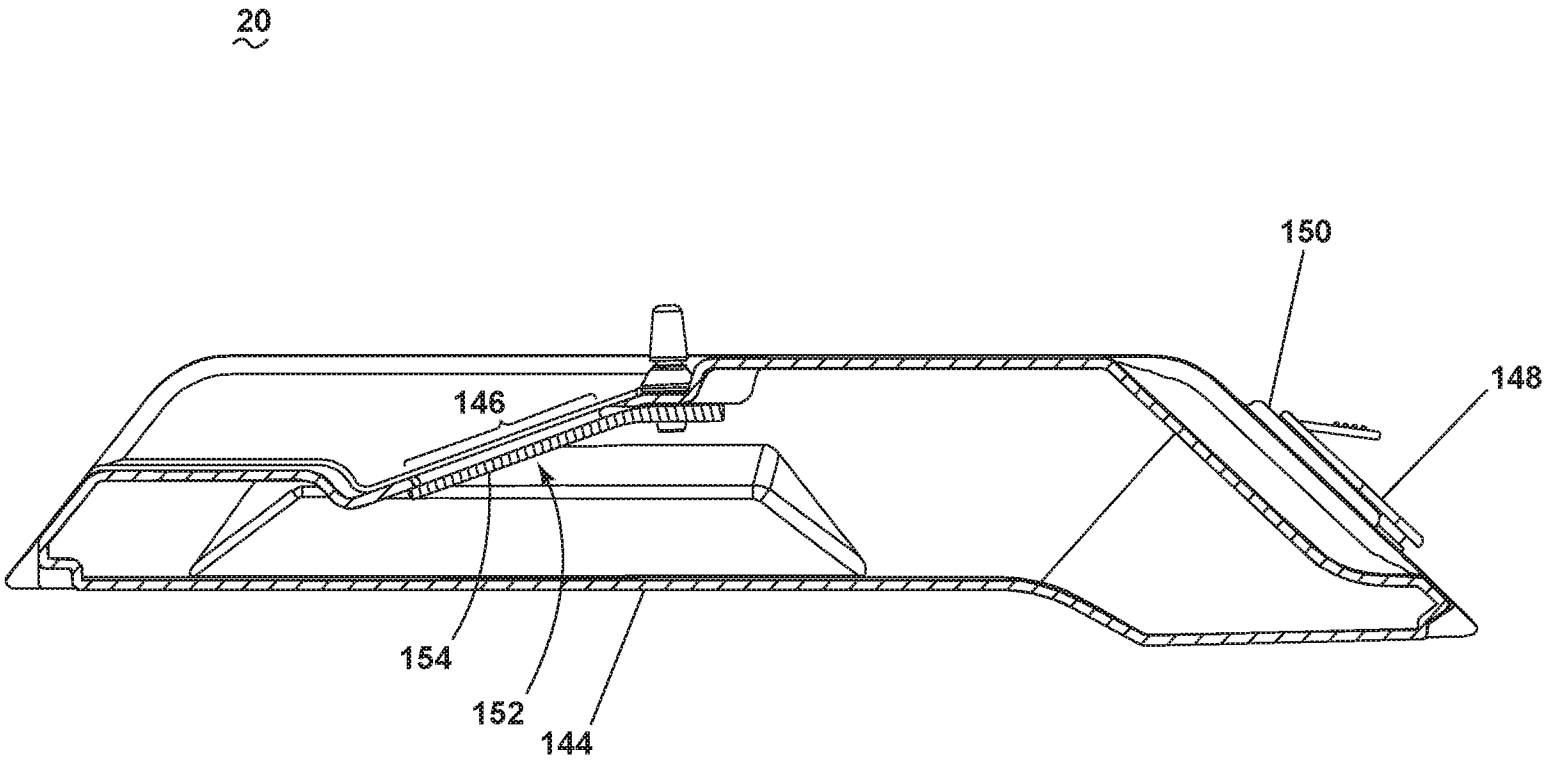
FIG. 12 is a sectional view through a centerline of a recovery tank of the handheld extraction cleaner from FIG. 1.

FIG. 12 is a sectional view through a centerline of a recovery tank 20 of the handheld extraction cleaner 10 from FIG. 1. The recovery tank 20 comprises a hollow tank body 144 with an inlet opening 146 that is in fluid communication with the separator 24 (FIG. 7). A removable tank cap 148 can be provided in an outlet opening 150 formed in the tank body 144 for draining any liquid in the recovery tank 20 that may be collected in the interior of the tank body 144. The recovery tank 20 can further include a flapper valve 152 that seals the inlet opening 146 when the recovery tank 20 is removed from the housing 12. The flapper valve 152 can include a flexible or resilient flap 154 that normally closes the inlet opening 146, as shown in FIG. 12 and which can elastically deform between the closed position shown in FIG. 12 and an open position shown in FIG. 14.

Figure 13:
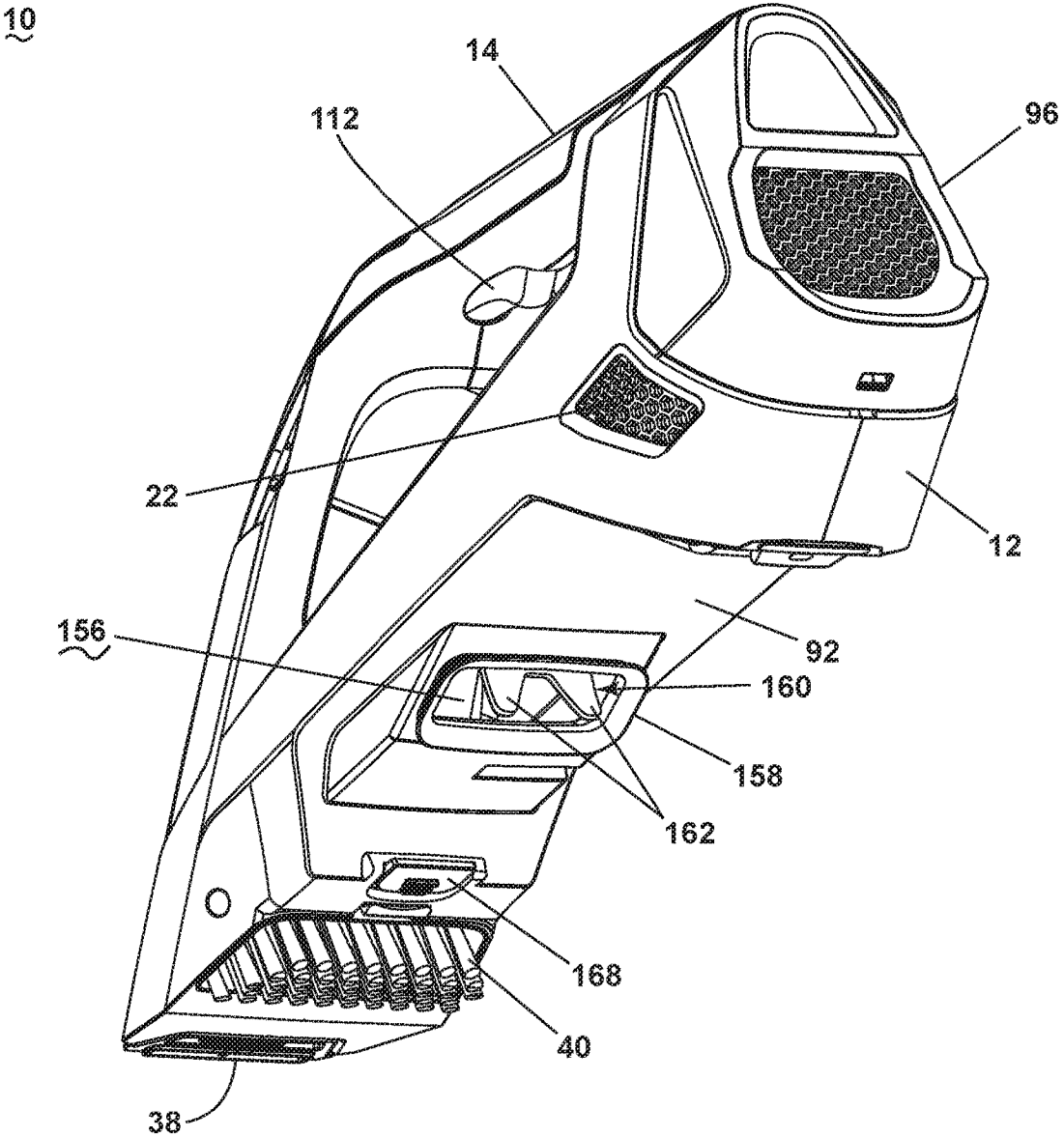
FIG. 13 is a bottom perspective view of the handheld extraction cleaner from FIG. 1 with the recovery tank removed.

FIG. 13 is a bottom perspective view of the handheld extraction cleaner 10 from FIG. 1 with the recovery tank 20 removed. The separator 24 includes a debris outlet 156 for transferring debris and liquid separated from the working airstream into the recovery tank 20. A seal 158 can be provided around the separator debris outlet 156 for preventing liquid or air leaks between the separator debris outlet 156 and the recovery tank inlet opening 146. A valve actuator 160 can be provided adjacent the separator debris outlet 156 in order to automatically open the flapper valve 152 when the recovery tank 20 is seated in the recovery tank receptacle 92. In one example of the present disclosure, the valve actuator 160 can comprise at least one rib 162 which pushes the flap 154 of the flapper valve 152 open, or away from the tank inlet opening 146, for example to the open position shown in FIG. 14. As illustrated, the valve actuator 160 includes a pair of ribs 162 projecting from a rear edge of the separator debris outlet 156.

Figure 14:
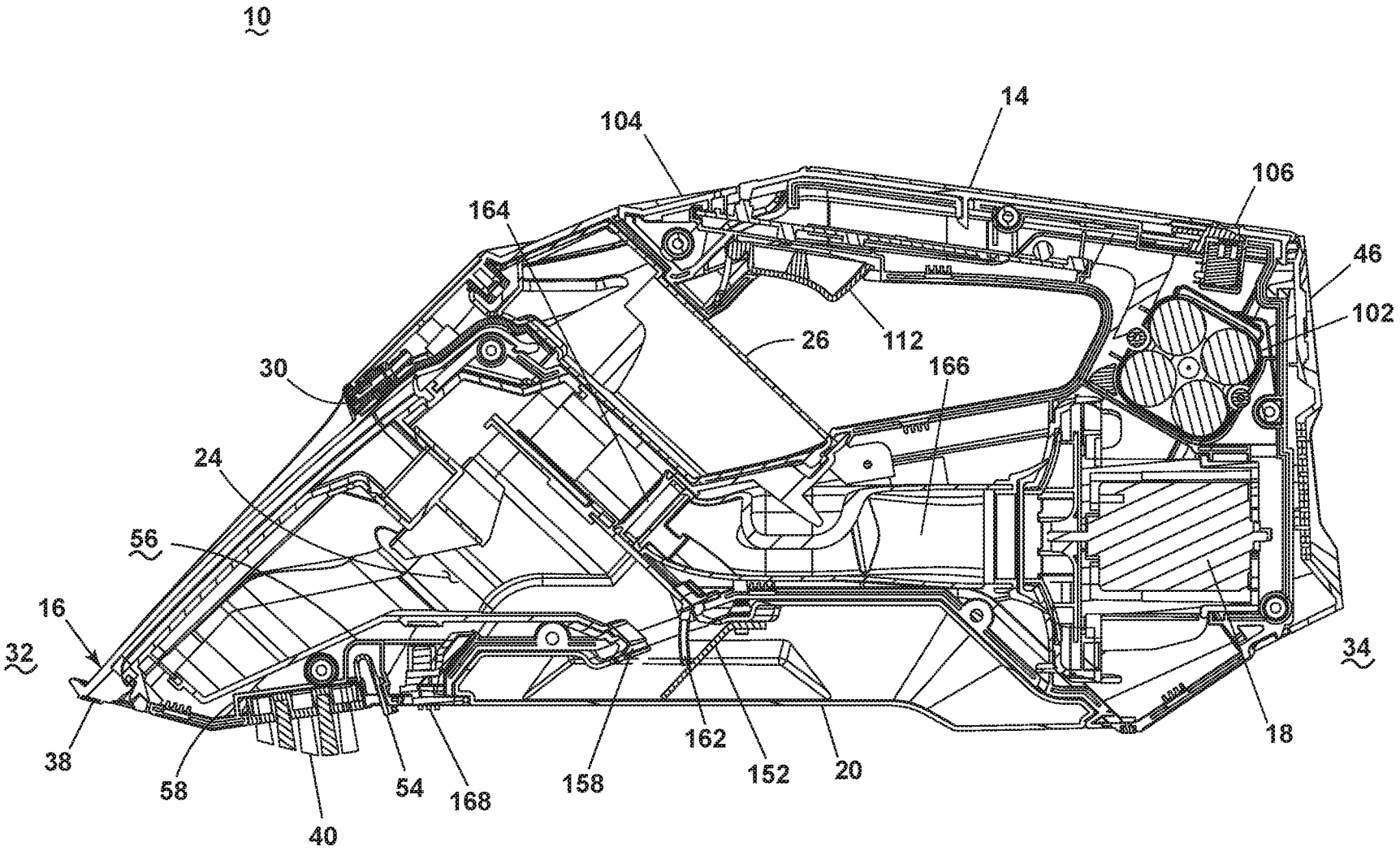
FIG. 14 is a sectional view of the handheld extraction cleaner taken through line XIV-XIV of FIG. 1.

FIG. 14 is a sectional view through a centerline of the handheld extraction cleaner 10 from FIG. 1. When the recovery tank 20 is mounted on the housing 12, the ribs 162 push open the flapper valve 152. Debris and liquid separated from the working airstream by the separator 24 can enter the recovery tank 20 via the aligned separator debris outlet 156 and recovery tank inlet opening 146. The seal 158 prevents debris, liquid and air leaks between the separator debris outlet 156 and the recovery tank inlet opening 146. The working airflow from the separator 24 passes through a separator air outlet 164 to an airflow conduit 166 connecting the separator 24 with the suction source 18.

The recovery tank 20 can be removably received in the recovery tank receptacle 92 formed on the bottom of the housing 12. A recovery tank latch 168 can be provided on the bottom of the housing 12 to secure the recovery tank 20 within the receptacle 92. Other mounting arrangements for the recovery tank 20 are possible.

Figure 15:
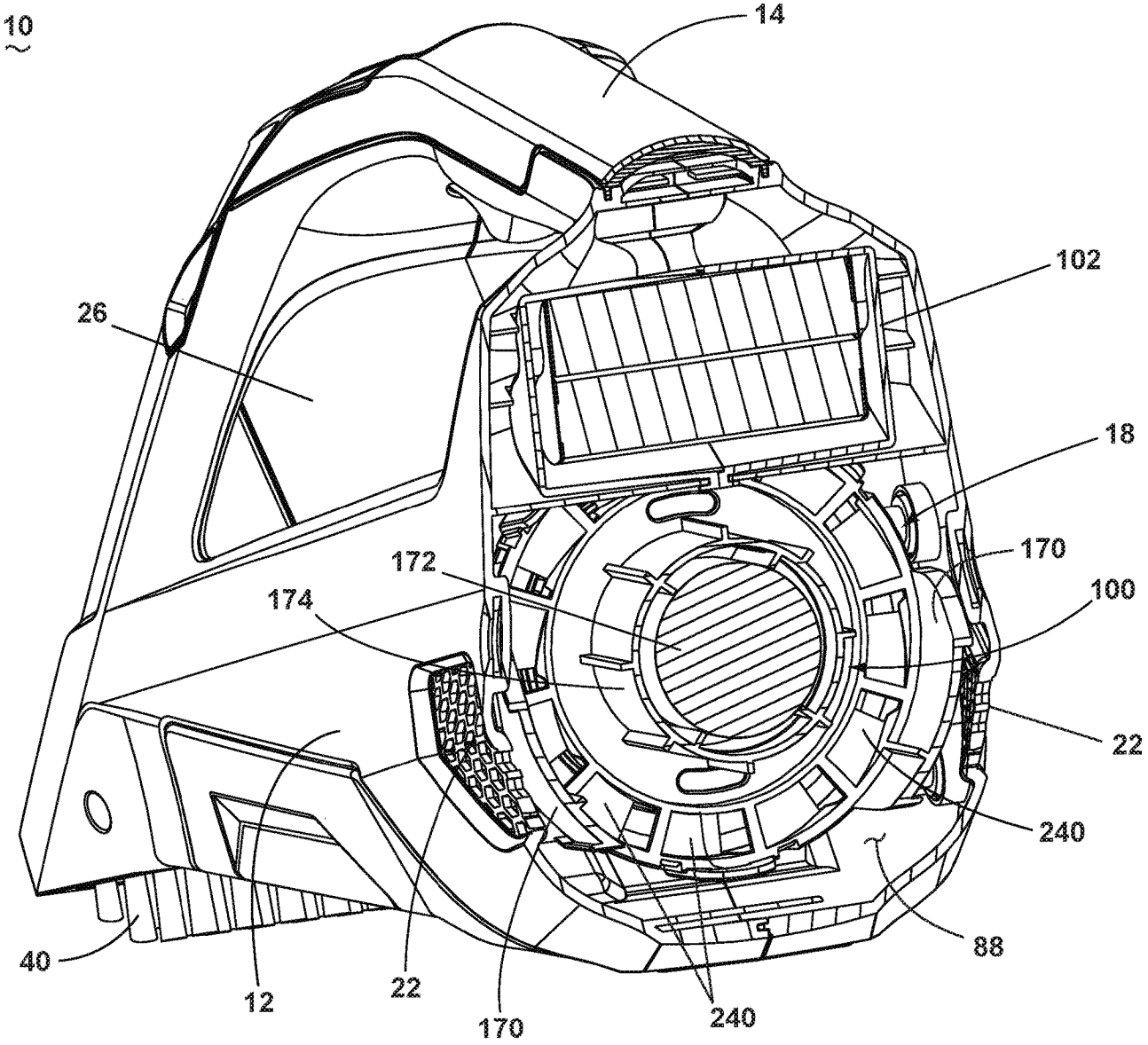
FIG. 15 is a rear perspective view of the handheld extraction cleaner from FIG. 1, with a portion cut away to show noise reduction baffles in a motor housing.
Figure 16:
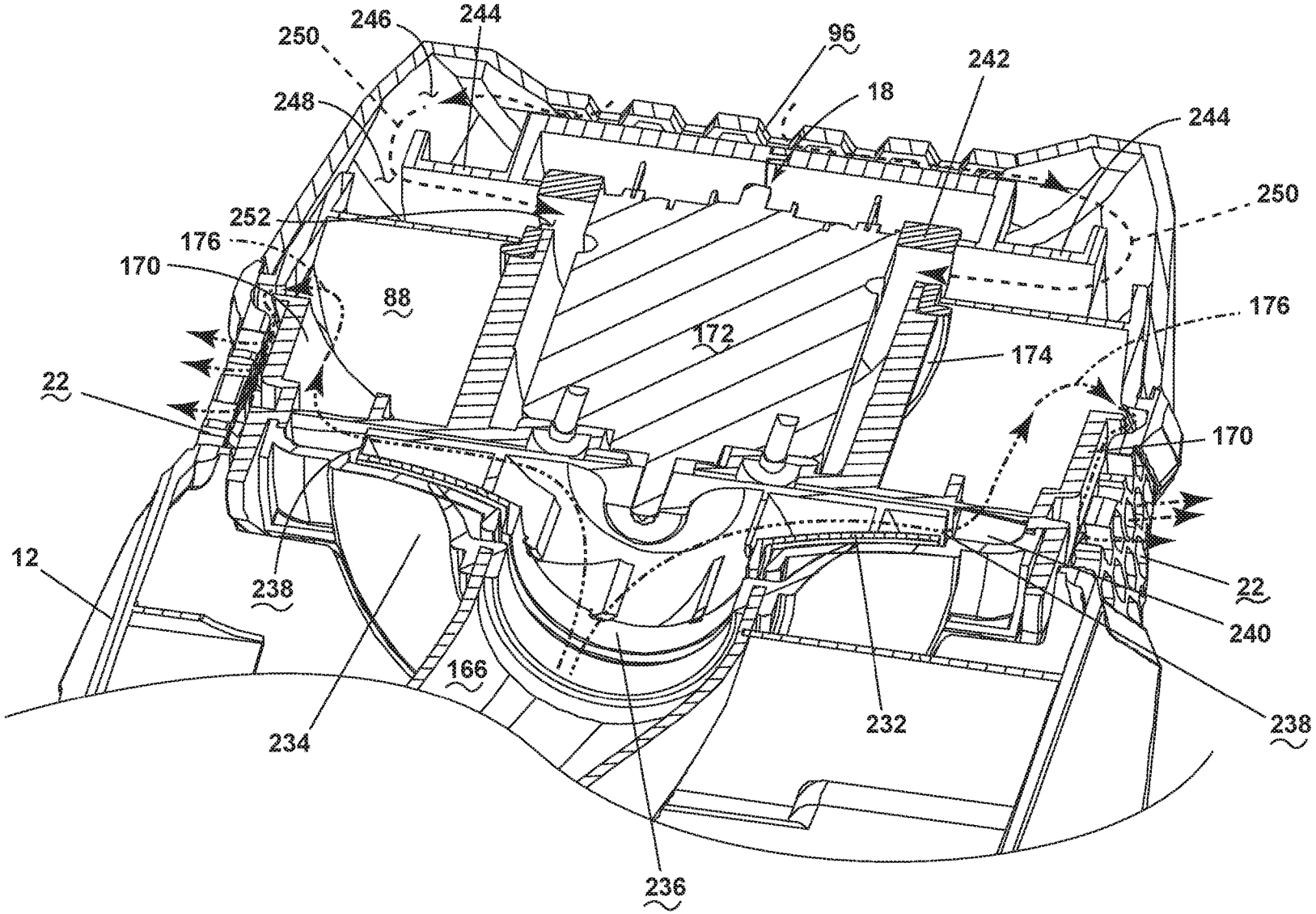
FIG. 16 is a sectional view of a rearward portion of the handheld extraction cleaner taken through line XVI-XVI of FIG. 1.

FIGS. 15-16 show noise reduction baffles 170 in a motor housing of the extraction cleaner 10. As discussed above, a portion of the housing 12 can form a motor/fan chamber 88 which receives the motor/fan assembly 18. More specifically, the motor/fan assembly 18 includes a motor 172 received in a motor housing 174 and a fan 232 received in a fan housing 234. The motor housing 174 substantially encloses the motor 172 and the fan housing 234 substantially encloses the fan 232.

At least one is baffle 170 is integrally formed with the motor housing 174 and dampens motor noise. The baffle 170 is spaced inwardly from at least one exhaust vent 22 formed in the outer housing 12 and is positioned to guide working exhaust on a tortuous path 176 flowing around the baffle 170 prior to exiting the exhaust vent 22. The motor and airflow noise generated by the handheld extraction cleaner 10 during operation is dampened by the tortuous working air exhaust path 176 formed by the baffle 170.

In the illustrated example, the working air exhaust flows through a fan inlet 236 at the center of the fan housing 234 and is expelled through openings 238 around the perimeter of the fan 232 into the motor housing 174. Angled vanes 240 on a rear-facing portion of the motor housing 174 (also referred to as a diffuser) guide the exhaust air rearwardly and in a centrifugal motion into the motor chamber 88, where the exhaust air confronts the baffles 170. The baffles 170 substantially overlie the exhaust vents 22, which forces working air exhaust to flow around the baffles 170 to exit the housing 12. The exhaust air flows around the baffles 170 in the tortuous path 176 and, in the example shown, must change direction by at least 180 degrees in order to exit the housing 12 through the exhaust vents 22.

The working air side of the motor 172 and cooling air side of the motor 172 are separated by a rubber gasket 242 fitted to the exterior can of the motor 172 and held by support ribs 244 that divide the motor chamber 88 from a cooling air cavity 246. Cooling air enters the cooling air cavity 246 through the motor cooling air inlet 96 formed in the back cover 94. Additional cooling inlet apertures 248 are formed in the housing 12 and together with the cavity 246 and the gasket 242 define a cooling air pathway 250, as indicated by arrows in FIG. 16, to cooling inlets 252 on the motor/fan assembly 18. The cooling air is exhausted through exhaust vent holes (not shown) on the back of the motor 172 and through the exhaust vents 22 formed in the housing 12.

The handheld extraction cleaner 10 can be used to effectively remove debris (which may include dirt, dust, soil, hair, and other debris) and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the present disclosure.

In operation, the extraction cleaner 10 is prepared for use by filling the supply tank 26 with cleaning fluid. The on/off button 104 is pressed to power the suction source 18 and pump 80. Cleaning fluid is selectively delivered to the surface to be cleaned via the fluid delivery system by user-activation of the trigger 112, while the forward end 32 of the extraction cleaner 10 is moved back and forth over the surface. The agitator 40 can simultaneously agitate the cleaning fluid into the surface to be cleaned. During operation of the recovery system, the extraction cleaner 10 draws in fluid and debris-laden working air through the suction nozzle 16, which defines a dirty air inlet of the recovery pathway and into the downstream recovery tank 20 where the fluid debris is substantially separated from the working air. The airstream then passes through the motor/fan assembly 18 prior to being exhausted from the extraction cleaner 10 through a clean air outlet of the recovery pathway defined by exhaust vents 22 in the housing 12. The recovery tank 20 can be periodically emptied of collected fluid and debris. The supply tank 26 may be refilled during a cleaning operation.

Figure 17:
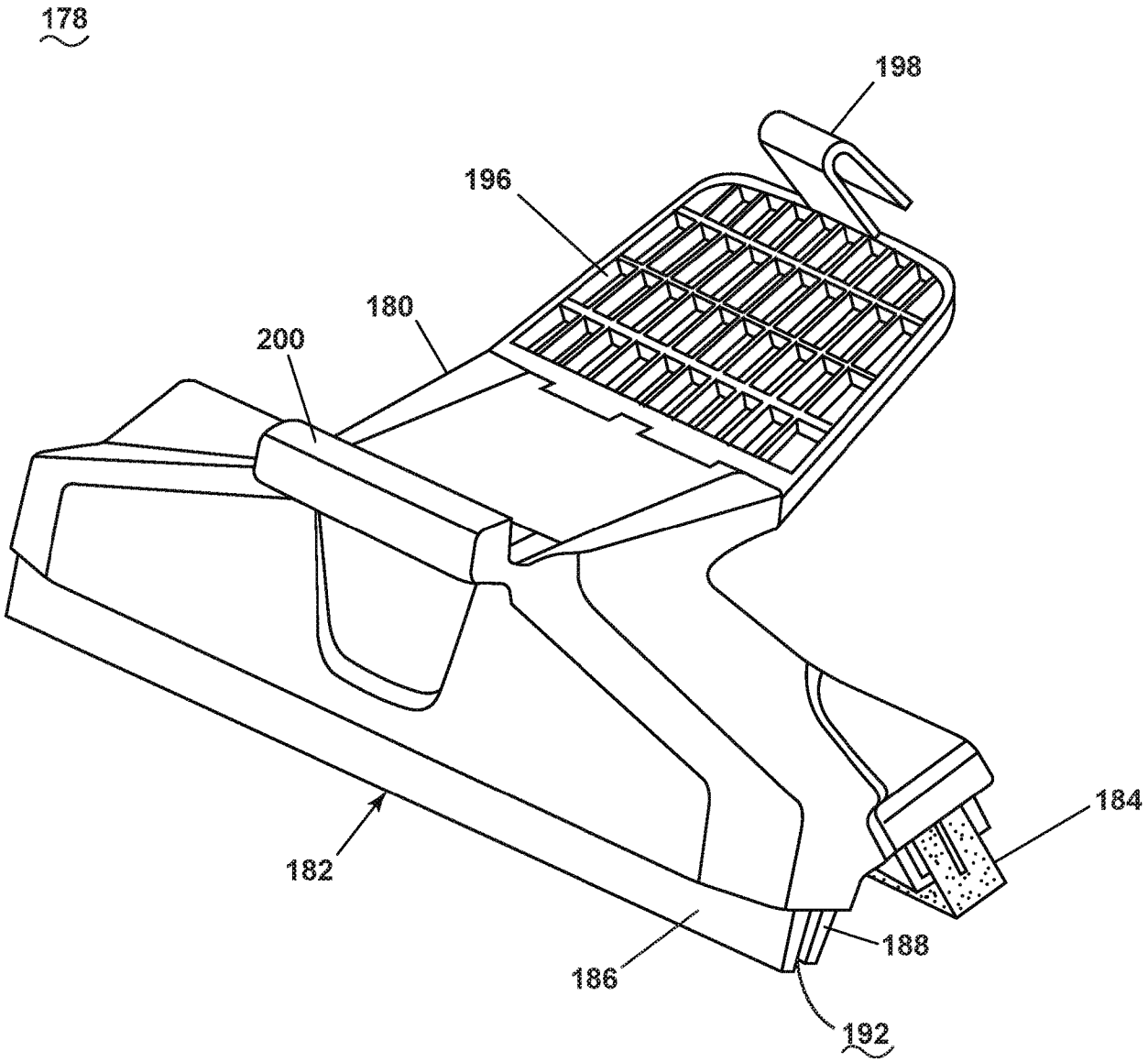
FIG. 17 is a top perspective view of a window cleaning attachment for the handheld extraction cleaner from FIG. 1.
Figure 18:
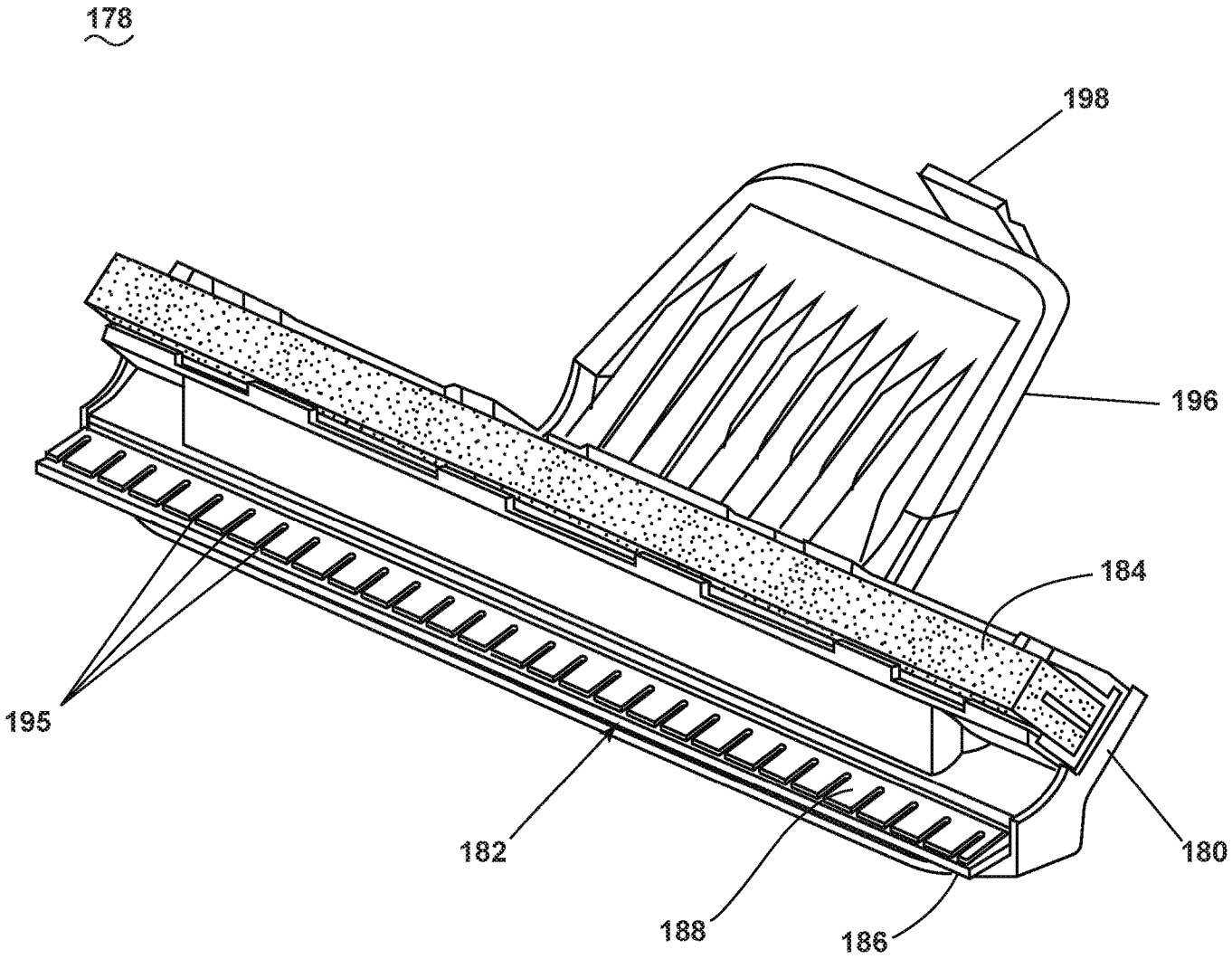
FIG. 18 is a bottom perspective view of the window cleaning attachment from FIG. 17.
Figure 19:
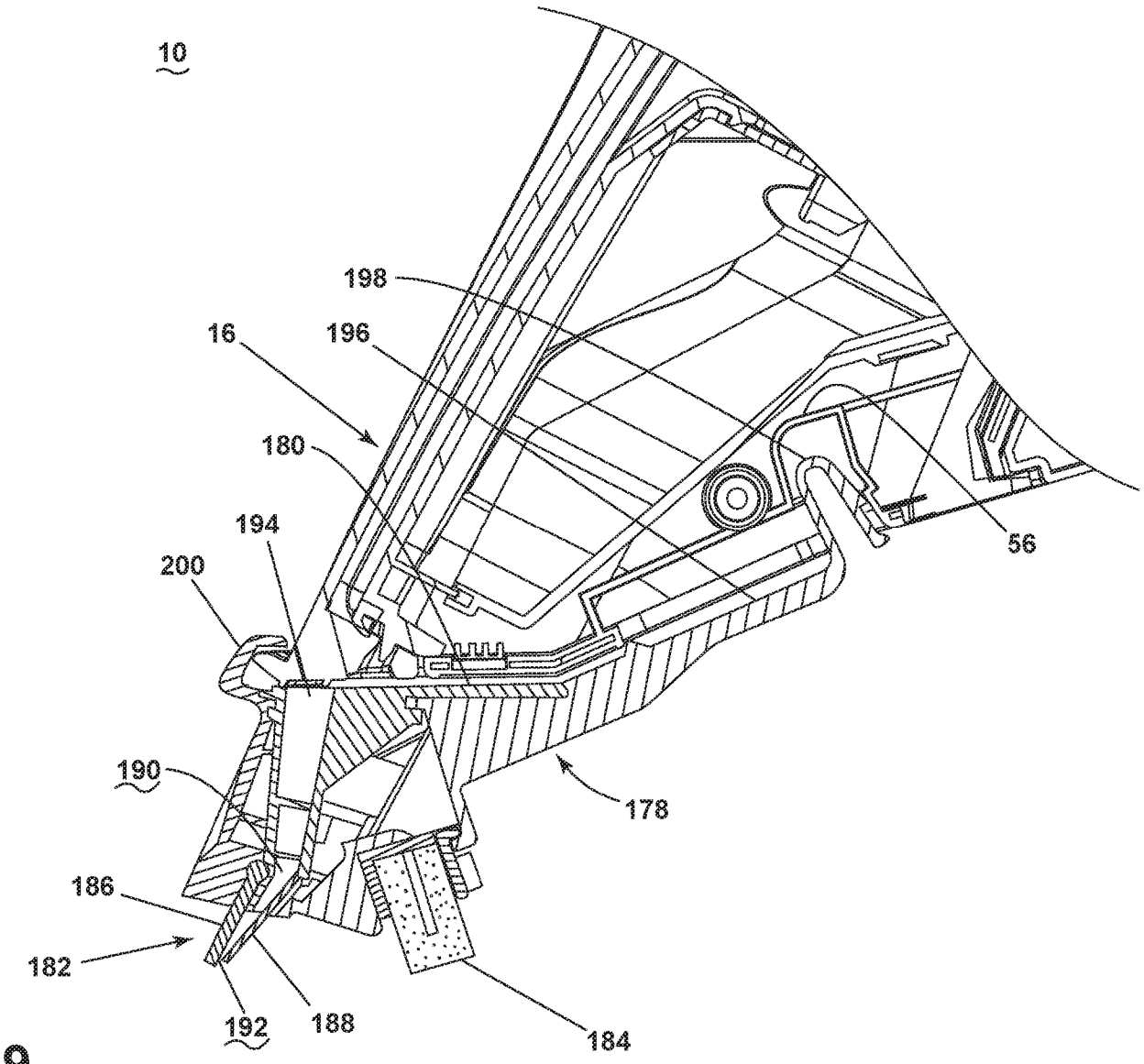
FIG. 19 is a sectional view through a centerline of the window cleaning attachment from FIG. 17.

FIGS. 17-19 are views of a window cleaning attachment 178 for the handheld extraction cleaner 10 from FIG. 1. The window cleaning attachment 178 can be attached to the handheld extraction cleaner 10 over the agitator 40, or, as for the example illustrated herein, in place of the agitator 40. The agitator 40 can be removed by disengaging the mounting latch 54 from the latch receptacle 56 (see FIG. 14) and the window cleaning attachment 178 can be mounted in its place The window cleaning attachment 178 comprises an attachment body 180 carrying a squeegee 182 and a foam scrubber 184. When mounted on the handheld extraction cleaner 10, the squeegee 182 and foam scrubber 184 are substantially below the suction nozzle 16.

The squeegee 182 can comprise an elongated wiper blade that is configured to scrape a window or window-like surface. The squeegee 182 is preferably at least as wide as the suction nozzle 16 of the extraction cleaner 10, and is more preferably wider than the suction nozzle 16. The squeegee 182 includes a front and rear squeegee wall 186, 188 defining a suction pathway 190 therebetween and through the body 180. The suction pathway 190 includes a nozzle inlet 192 at the terminal end of the squeegee walls 186, 188 and a nozzle outlet 194 at an upper side of the body. The nozzle outlet 194 is configured to align with the suction nozzle 16 on the extraction cleaner 10 to place the squeegee suction pathway 190 in fluid communication with the recovery system of the extraction cleaner 10.

In the example shown herein, the front wall 186 is solid, whereas the rear wall 188 can have a crenulated shape further comprising a plurality of slits 195 in the rear wall 188 that extend orthogonally from a bottom edge of the rear wall 188. The slits 195 allow liquid to pass into the suction pathway 190 and get entrained in the working airflow when the window cleaning attachment 178 is moved on a rearward cleaning stroke. In other examples, the slits 195 may be eliminated, but without the slits 195, the rear wall 188 may merely push the liquid and prevent it from being extracted.

The foam scrubber 184 can comprise an elongated foam material that is configured to clean a window or window-like surface. The foam scrubber 184 is preferably at least as wide as the suction nozzle 16, and is more preferably wider than the suction nozzle 16, such as being approximately as wide as the squeegee 182.

The foam scrubber 184 can project from the body 180 at an angle to the squeegee 182 so that the two cleaning implements 182, 184 are oriented along different planes. With this configuration, the user can selectively bring the squeegee 182 or the foam scrubber 184 into contact with the surface to be cleaned by pivoting the carry handle 14 on the extraction cleaner 10. For example, during a cleaning operation, a user may first apply cleaning solution to a window from the fluid delivery system, scrub the window with the foam scrubber 184, and then scrape the window with the squeegee 182 while operating the recovery system.

Referring to FIG. 19, the body 180 further includes a mounting plate 196 and a mounting latch 198 configured to engage the latch receptacle 56 on the bottom of the housing 12 to retain the window cleaning attachment 178 on the bottom of the housing 12, with the mounting plate 196 approximately within the brush receptacle 58 and the front end of the body 180 which carries the squeegee 182 and foam scrubber 184 extending under the suction nozzle 16. The mounting latch 198 shown herein is a biased bearing retainer that frictionally engages the latch receptacle 56. The front end of the body 180 can further include a hook 200 that engages the front lower end of the suction nozzle 16 to help retain the attachment 178 on the extraction cleaner 10.

To the extent not already described, the different features and structures of the various examples of the present disclosure, may be used in combination with each other as desired, or may be used separately. That one handheld extraction cleaner 10 is illustrated herein as having all of these features does not mean that all of these features must be used in combination, but rather done so here for brevity of description. Furthermore, while the extraction cleaner 10 shown herein is handheld, some features of the present disclosure can be useful on a conventional upright or stick cleaner. Still further, the extraction cleaner 10 can additionally have steam delivery capability. Thus, the various features of the different examples may be mixed and matched in various extraction cleaner configurations as desired to form new examples, whether or not the new examples are expressly described.

While the present disclosure has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A handheld extraction cleaner, comprising:

a unitary body;

a working air path through the body having a dirty air inlet and a clean air outlet;

a suction nozzle carried by the body and defining the dirty air inlet;

a suction motor received within a motor housing and carried by the body, the suction motor fluidly coupled with the suction nozzle;

a recovery tank carried by the body and fluidly coupled with the suction nozzle;

at least one exhaust vent disposed in the body and defining the clean air outlet; and at least one baffle disposed between the motor housing and the at least one exhaust vent and fluidly coupled with the working air path, and wherein the at least one baffle is configured to dampen noise, wherein the at least one baffle is integrally formed with the motor housing.

2. The handheld extraction cleaner according to claim 1 wherein the at least one baffle overlies the at least one exhaust vent such that exhaust air flowing through the working air path changes direction by at least 180 degrees before exiting through the at least one exhaust vent.

3. The handheld extraction cleaner according to claim 1 wherein the at least one baffle and the at least one exhaust vent define a tortuous path for exhaust air prior to exiting through the at least one exhaust vent.

4. The handheld extraction cleaner according to claim 3 wherein the tortuous path flows around the at least one baffle prior to exiting the at least one exhaust vent.

5. The handheld extraction cleaner according to claim 1 wherein a chamber is disposed between the body and the motor housing, and wherein the at least one baffle is disposed between the at least one exhaust vent and the chamber such that exhaust air in the chamber flows around the at least one baffle prior to exiting through the at least one exhaust vent.

6. The handheld extraction cleaner according to claim 5 further comprising a fan disposed within a fan housing, and wherein exhaust air is expelled through openings around a perimeter of the fan.

7. The handheld extraction cleaner according to claim 6 wherein the motor housing comprises angled vanes on a rear-facing portion of the motor housing, and wherein exhaust air expelled by the fan flows through the angled vanes and into the chamber.

8. The handheld extraction cleaner according to claim 1 further comprising a separator carried by the body and fluidly coupled with the working air path, the separator configured to transfer debris and liquid separated from the working air path into the recovery tank.

9. The handheld extraction cleaner according to claim 8 wherein the separator is configured to transfer exhaust air separated from the work air path into an airflow conduit fluidly coupled with the at least one baffle.

10. The handheld extraction cleaner according to claim 1 further comprising:

a fluid supply assembly carried by with the body, the fluid supply assembly including a supply tank fluidly coupled with a fluid distributor; and a separator carried by the body and fluidly coupled with the working air path, the separator configured to transfer debris and liquid separated from the working air path into the recovery tank.

11. A handheld extraction cleaner, comprising:

a unitary body having a dirty air inlet and a clean air outlet;

a working air path through the body between the dirty air inlet and the clean air outlet;

a suction nozzle defining at least a portion of the dirty air inlet;

a suction motor fluidly coupled with the suction nozzle;

a fan housing configured to at least partially house a fan coupled with the suction motor;

a motor housing configured to at least partially house the suction motor and fluidly coupled with the working air path through one or more openings in the fan housing; and at least one baffle integrally formed with the motor housing to dampen noise.

12. The handheld extraction cleaner according to claim 11 wherein at least one exhaust vent disposed in the body at least partially defines the clean air outlet, and the at least one baffle overlies the at least one exhaust vent such that exhaust air flowing through the working air path changes direction by at least 180 degrees before exiting through the at least one exhaust vent.

13. The handheld extraction cleaner according to claim 11 wherein at least one exhaust vent disposed in the body at least partially defines the clean air outlet, and the at least one baffle and the at least one exhaust vent define a tortuous path for exhaust air prior to exiting through the at least one exhaust vent.

14. The handheld extraction cleaner according to claim 13 wherein the tortuous path flows around the at least one baffle prior to exiting the at least one exhaust vent.

15. The handheld extraction cleaner according to claim 11 wherein at least one exhaust vent disposed in the body at least partially defines the clean air outlet, and a chamber is disposed between the body and the motor housing, and wherein the at least one baffle is disposed between the at least one exhaust vent and the chamber such that exhaust air in the chamber flows around the at least one baffle prior to exiting through the at least one exhaust vent.

16. The handheld extraction cleaner according to claim 15 further comprising openings around a perimeter of the fan through which exhaust air is expelled a fan disposed within a fan housing such that the exhaust air is expelled through openings around a perimeter of the fan.

17. The handheld extraction cleaner according to claim 16 wherein the motor housing comprises angled vanes on a rear-facing portion of the motor housing, and wherein the exhaust air expelled by the fan flows through the angled vanes and into the chamber.

18. The handheld extraction cleaner according to claim 11 further comprising:

a recovery tank fluidly coupled with the suction nozzle; and a separator configured to transfer debris and liquid into the recovery tank, the separator configured to separate the debris and liquid from exhaust air carried within the working air path.

19. The handheld extraction cleaner according to claim 18 wherein the separator is configured to transfer the exhaust air separated from the work air path into an airflow conduit fluidly coupled with the at least one baffle.

* * * * *